US010294059B2

(12) United States Patent
Tokuma

(10) Patent No.: US 10,294,059 B2
(45) Date of Patent: May 21, 2019

(54) IMAGE FORMING APPARATUS AND SHEET PROCESSING APPARATUS

(71) Applicant: CANON KABUSHIKI KAISHA, Tokyo (JP)

(72) Inventor: Naoto Tokuma, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 92 days.

(21) Appl. No.: 15/176,575

(22) Filed: Jun. 8, 2016

(65) Prior Publication Data

US 2016/0378047 A1 Dec. 29, 2016

(30) Foreign Application Priority Data

Jun. 25, 2015 (JP) ..... 2015-127847

(51) Int. Cl.
*B65H 31/10* (2006.01)
*G03G 15/00* (2006.01)
(Continued)

(52) U.S. Cl.
CPC ..... *B65H 31/10* (2013.01); *B65H 29/14* (2013.01); *B65H 31/12* (2013.01); *B65H 31/38* (2013.01);
(Continued)

(58) Field of Classification Search
CPC ..... B65H 29/14; B65H 31/04; B65H 31/08; B65H 31/10; B65H 31/12; B65H 31/18; B65H 31/20; B65H 31/34; B65H 43/06; B65H 2301/142; B65H 2301/212; B65H 2511/13; B65H 2511/15; B65H 2511/152; B65H 2511/182; B65H 2515/81; B65H 2601/271; B65H 2601/523; G03G 15/5029; G03G 15/6594; G03G 2215/00738; G03G 2215/00742
See application file for complete search history.

(56) References Cited

U.S. PATENT DOCUMENTS 7,046,941 B2 5/2006 Kameyama et al.
7,336,922 B2 2/2008 Terao et al.
(Continued)

FOREIGN PATENT DOCUMENTS

CN 2632726 Y 8/2004
CN 1754803 A 4/2006
(Continued)

OTHER PUBLICATIONS

Chinese Office Action dated Nov. 6, 2017, in related Chinese Patent Application No. 2016-10458118.8.

*Primary Examiner* — Ernesto A Suarez
(74) *Attorney, Agent, or Firm* — Venable LLP

(57) ABSTRACT

An image forming apparatus includes an image forming unit forming images on a first sheet and a second sheet having a higher stiffness than the first sheet, a discharge rotary member pair, and a sheet supporting unit to support the first and second sheets discharged through the discharge rotary member pair. In addition, an abutment surface abuts against upstream ends of the first and second sheets supported on the sheet supporting unit, and an elevation unit moves the sheet supporting unit up and down. A control unit, in a state where no sheet is supported on the sheet supporting unit, executes a first discharge mode of controlling the elevation unit to position the sheet supporting unit at a first position before the discharge rotary member pair starts discharging the first sheet, and a second discharge mode of controlling the elevation unit to position the sheet supporting unit at a second position lower than the first position.

18 Claims, 17 Drawing Sheets

(51) Int. Cl.

| | |
|---|---|
| ***B65H 29/14*** | (2006.01) |
| ***B65H 31/12*** | (2006.01) |
| ***B65H 31/38*** | (2006.01) |
| ***B65H 43/06*** | (2006.01) |

(52) U.S. Cl.

CPC ..... *B65H 43/06* (2013.01); *G03G 15/6552* (2013.01); *G03G 15/6555* (2013.01); *B65H 2405/1111* (2013.01); *B65H 2405/11151* (2013.01); *B65H 2511/11* (2013.01); *B65H 2511/13* (2013.01); *B65H 2511/152* (2013.01); *B65H 2511/20* (2013.01); *B65H 2511/30* (2013.01); *B65H 2511/51* (2013.01); *B65H 2515/81* (2013.01); *B65H 2553/412* (2013.01); *B65H 2801/31* (2013.01); *G03G 2215/00421* (2013.01)

(56) References Cited

U.S. PATENT DOCUMENTS

| | | | | |
|---|---|---|---|---|
| 7,798,481 | B2 * | 9/2010 | Terao | B65H 31/10 270/58.04 |
| 7,850,170 | B2 | 12/2010 | Matsue et al. | |
| 8,128,085 | B2 * | 3/2012 | Seki | B65H 29/125 271/209 |
| 8,320,030 | B2 | 11/2012 | Kimura | |
| 8,714,538 | B2 * | 5/2014 | Miyake | B65H 31/34 270/58.09 |
| 8,794,617 | B2 | 8/2014 | Tokuma | |
| 8,851,468 | B2 | 10/2014 | Tokuma | |
| 9,008,568 | B2 * | 4/2015 | Shimura | B65H 29/14 270/58.12 |
| 9,033,330 | B2 | 5/2015 | Tokuma | |
| 9,067,753 | B2 | 6/2015 | Tokuma et al. | |
| 9,102,497 | B2 | 8/2015 | Tokuma | |
| 9,567,177 | B2 * | 2/2017 | Sugitani | B65H 29/14 |
| 9,708,149 | B2 * | 7/2017 | Arai | B65H 43/02 |
| 2003/0193125 | A1 | 10/2003 | Saegusa | |
| 2007/0145660 | A1 * | 6/2007 | Terao | B42C 1/12 270/58.02 |
| 2010/0110510 | A1 | 5/2010 | Kimura | |
| 2013/0285320 | A1 * | 10/2013 | Tokuma | B65H 29/00 271/306 |
| 2017/0036882 | A1 * | 2/2017 | Yokoya | B65H 43/06 |

FOREIGN PATENT DOCUMENTS

| | | | |
|---|---|---|---|
| CN | 1827508 | A | 9/2006 |
| JP | 2010-111477 | A | 5/2010 |

* cited by examiner

IMAGE FORMING APPARATUS AND SHEET PROCESSING APPARATUS

BACKGROUND OF THE INVENTION

Field of the Invention

The present invention relates to an image forming apparatus forming an image on a sheet, and a sheet processing apparatus processing sheets.

Description of the Related Art

Hitherto, when an image forming apparatus is used to carry out an image forming process, at first, a sheet is fed to an image forming unit to have toner images formed on the sheet, and then the toner images are fixed to the sheet via a fixing unit. Next, the sheet having the toner images fixed thereto is discharged through a sheet discharge port to an outer side of the apparatus. When subjecting the sheet to a binding process and the like, the sheet onto which toner image has been formed is conveyed to a sheet processing apparatus, where the sheet is subjected to a binding process and the like, and then the sheet is discharged through the sheet discharge port, and supported on a sheet support tray provided on the sheet supporting device.

When the sheet is heated in the fixing unit, the sheet may be curled upward or downward significantly at both end portions along a sheet discharge direction, depending on conditions. If the sheet is supported on the sheet support tray in such a state with both end portions curled, both end portions of the sheet may obstruct the sheet discharge port. In that case, the supported sheet may be pushed by the subsequently discharged sheet, and the alignment of the sheets may be deteriorated or the sheet may fall off from the sheet support tray.

Therefore, a sheet supporting surface of the sheet support tray has been formed conventionally as a ridge shape, having a first support surface, and a second support surface provided downstream in a sheet discharge direction of the first support surface and having a somewhat shallower angle than the first support surface with respect to a horizontal direction, in order to accurately support the sheet having both end portions curled. According to this configuration of the sheet supporting surface of the sheet support tray, when the curled sheet is supported, the sheet will follow the shape of the sheet supporting surface and the curl on the sheet will be cancelled.

There are increasing demands of forming images on a sheet having a high stiffness called super-thick paper, having a basis weight of approximately 350 g/m$^2$ to 400 g/m$^2$, and supporting such sheet on the sheet supporting device. The sheet having such high stiffness may have its leading end, i.e., downstream end in the sheet discharge direction, curled significantly downward. In that case, if the position of the sheet support tray is positioned close to the sheet discharge port, the leading end of the sheet may be caught on the sheet support tray, and the sheet may not be discharged appropriately. Further, the sheet may collide against a sheet already supported on the sheet support tray, and may push the already supported sheet off the sheet support tray.

Japanese Unexamined Patent Application Publication No. 2010-111477 proposes forming a sheet support tray capable of being moved up and down, and when a sheet having a high stiffness is discharged, the position of the sheet support tray is placed lower than when a sheet having a low stiffness is discharged.

However, in the case of such sheet supporting device disclosed in Japanese Unexamined Patent Application Publication No. 2010-111477, the sheet supporting surface of the sheet support tray is flat, so that the curl of the sheet having both end portions curled will not be cancelled by having the sheet supported on the tray. In that case, both ends of the sheet may obstruct the sheet discharge port, as described earlier, and the supported sheet may be pushed by the subsequently discharged sheet, and the alignment of the sheets may be deteriorated or the sheet may fall off from the sheet support tray. If the sheet support tray is too low, the discharged sheet may fall off from a downstream side in the sheet discharge direction of the sheet support tray.

SUMMARY OF THE INVENTION

According to one aspect of the present invention, an image forming apparatus includes an image forming unit forming an image on a sheet, a discharge rotary member pair discharging the sheet on which an image has been formed by the image forming unit, a sheet supporting unit on which the sheet discharged by the discharge rotary member pair is supported, the sheet supporting unit including a first support surface, and a second support surface provided downstream, in a sheet discharge direction, of the first support surface, and having a smaller inclination angle than the first support surface with respect to a horizontal surface, an abutment surface against which an upstream end, in the sheet discharge direction, of the sheet supported on the sheet supporting unit abuts, an elevation unit moving the sheet supporting unit up and down, and a control unit configured to execute a first discharge mode controlling the elevation unit such that the sheet supporting unit is positioned at a first position before the discharge rotary member pair starts discharging a first sheet, and a second discharge mode controlling the elevation unit such that the sheet supporting unit is positioned at a second position lower than the first position and where an intersection between an extension line of the second support surface and an extension line of the abutment surface is positioned lower than a nip of the discharge rotary member pair before the discharge rotary member pair starts discharging a second sheet having a higher stiffness than the first sheet.

A second aspect of the present invention relates to a sheet processing apparatus including a sheet processing unit processing a sheet, a discharge rotary member pair discharging the sheet having been processed by the sheet processing unit, a sheet supporting unit on which the sheet discharged by the discharge rotary member pair is supported, the sheet supporting unit including a first support surface, and a second support surface provided downstream, in a sheet discharge direction, of the first support surface, and having a smaller inclination angle than the first support surface with respect to a horizontal surface, an abutment surface against which an upstream end, in the sheet discharge direction, of the sheet supported on the sheet supporting unit abuts, an elevation unit moving the sheet supporting unit up and down, and a control unit configured to execute a first discharge mode controlling the elevation unit such that the sheet supporting unit is positioned at a first position before the discharge rotary member pair starts discharging a first sheet, and a second discharge mode controlling the elevation unit such that the sheet supporting unit is positioned at a second position lower than the first position and where an intersection between an extension line of the second support surface and an extension line of the abutment surface is positioned lower than a nip of the discharge rotary member pair before the discharge rotary member pair starts discharging a second sheet having a higher stiffness than the first sheet.

Further features of the present invention will become apparent from the following description of exemplary embodiments with reference to the attached drawings.

DESCRIPTION OF THE EMBODIMENTS

Figure 1:
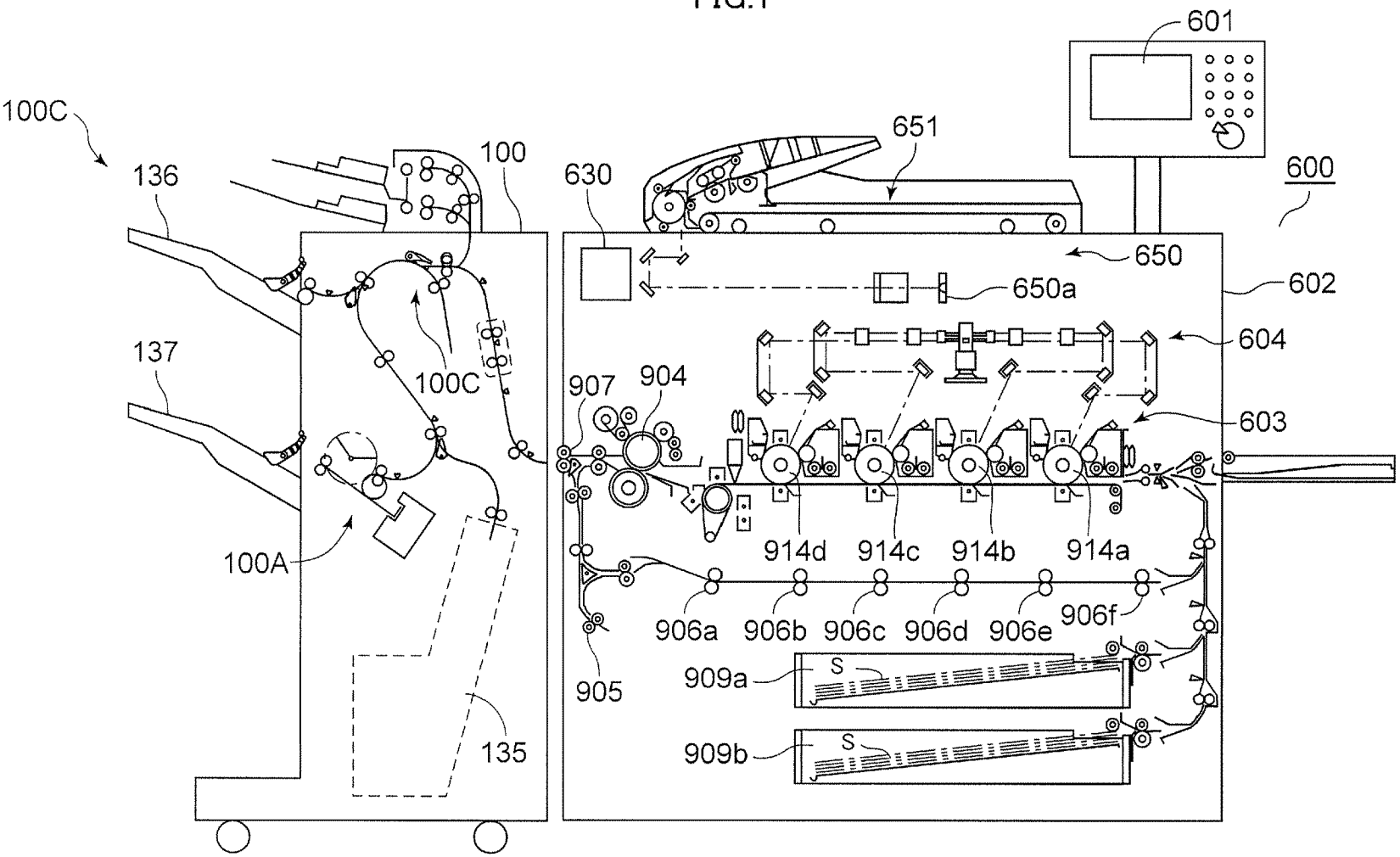
FIG. 1 is a general schematic view of a black-and-white/color copying machine according to a first embodiment.

Now, preferred embodiments for carrying out the present invention will be described in detail with reference to the drawings. FIG. 1 is a view of a configuration of a black-and-white/color copying machine as an example of an image forming apparatus having a sheet processing apparatus according to a first embodiment. As illustrated in FIG. 1, a black-and-white/color copying machine 600, i.e., image forming apparatus, includes a black-and-white/color copying machine body (hereinafter referred to as copying machine body) 602, a finisher 100, and an operation unit 601. A document conveyance apparatus 651 for automatically reading a plurality of documents is provided on an upper surface of a copying machine body 602. A document reading unit, i.e., image reader, 650 is provided on an upper portion of the copying machine body 602.

The copying machine body 602 includes sheet feed cassettes 909*a* and 909*b* supporting normal sheets S on which images are to be formed, an image forming unit 603 forming toner images on a sheet through an electro-photographic process, a fixing unit 904 fixing the toner images formed on the sheets, and so on. Further, the operation unit 601 allowing a user to enter various information and settings to the copying machine body 602 is connected to an upper surface of the copying machine body 602, and the finisher 100, i.e., sheet processing apparatus, is connected to a side portion of the copying machine body 602 . A CPU circuit unit 630, i.e., a controller, controlling the copying machine body 602 and the finisher 100, is provided at a predetermined position on the copying machine body 602.

When forming an image of a document not shown on a sheet in such black-and-white/color copying machine 600, at first, an image of a document conveyed via the document conveyance apparatus 651 is read through an image sensor 650*a* provided on a document reading unit 650. Thereafter, the image information having been read is entered to an exposing unit 604, and the exposing unit 604 irradiates light corresponding to the image information to photosensitive drums 914*a* through 914*d* provided on the image forming unit 603. When lights are irradiated in this manner, electrostatic latent images are formed on the surface of the photosensitive drums, and yellow, magenta, cyan and black color toner images are formed on the photosensitive drum surface by developing the electrostatic latent images.

Next, the four-color toner images are transferred onto a sheet fed from sheet feed cassettes 909*a* and 909*b*, and thereafter, the toner images transferred onto the sheet are fixed permanently via the fixing unit 904. After the toner image is fixed in this manner, if a mode of forming an image on one side of a sheet is selected, the sheet is discharged through an upper sheet discharge roller pair 907 to the finisher 100 connected to a side portion of the copying machine body 602.

When a mode of forming images on both sides of a sheet is selected, the sheet is delivered from the fixing unit 904 to a reverse conveyance roller 905, and thereafter, the reverse conveyance roller 905 is reversed at a predetermined timing, and the sheet is conveyed toward duplex conveyance rollers 906*a* through 906*f*. Thereafter, the sheet is conveyed again to the image forming unit 603, where four-color toner images of yellow, magenta, cyan and black are transferred to a rear surface. The sheet having the four-color toner images transferred to the rear surface thereof is conveyed again to the fixing unit 904, where the toner images are fixed, and then the sheet is discharged via the upper sheet discharge roller pair 907 and conveyed to the finisher 100.

The finisher 100 is designed to take in the sheets discharged from the copying machine body 602 one by one, and carry out a process of aligning the plurality of sheets having been taken in and bundling the sheets into a single bundle, and a punching process of forming holes near an upstream end of the sheets. The finisher 100 is also designed to carry out processes such as a stapling process, i.e., binding process, of stapling a trailing-end side of the bundle of sheets, a bookbinding process, and so on. The finisher 100 includes, as sheet processing units processing sheets, a stapling unit 100A stapling the sheets, and a saddle unit 135 folding the sheet bundle in two and bookbinding the sheets. Further, the finisher 100 includes a sheet supporting device 100C having an upper tray 136 and a lower tray 137 as sheet supporting units on which processed sheets are supported.

Figure 2:
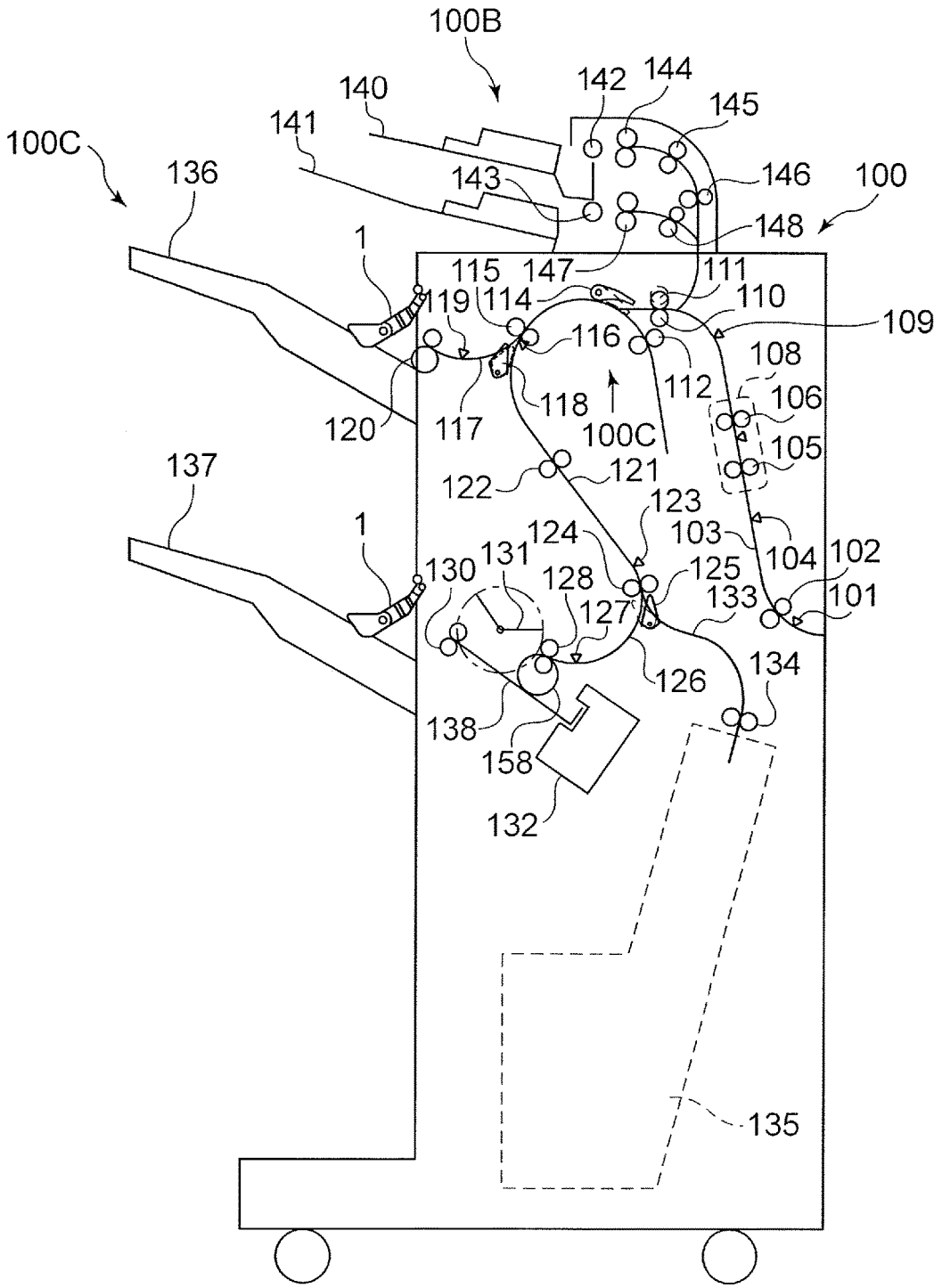
FIG. 2 is a front view of a finisher.

The finisher 100 includes an inlet roller pair 102 taking in sheets to the interior of the apparatus, as illustrated in FIG. 2, and the sheets discharged from the copying machine body 602 are delivered to the inlet roller pair 102. The delivery timing of the sheet is simultaneously detected at this time by the inlet sensor 101.

Thereafter, the sheet having been conveyed via the inlet roller pair 102 passes through a conveyance path 103, where a width-direction end portion of the sheet is detected by a lateral registration detection sensor 104 to detect how much the sheet has been deviated in the width direction with respect to a center position of the finisher 100. After the width-direction deviation (hereinafter referred to as a lateral registration error) is detected in this manner, a sheet shift operation is carried out by having a shift unit 108 move for a predetermined amount in a front direction or a back direction while the sheet is being conveyed by a shift roller pair 105 and 106. In the specification, the term "front direction" refers to a front side of an apparatus that the user faces when he/she stands in front of the operation unit 601 illustrated in FIG. 1, and "back" refers to a back side of the apparatus.

Next, the sheet is conveyed via a conveyance roller 110 and a separation roller 111, and reaches a buffer roller pair 115. Thereafter, when the sheet is discharged onto the upper tray 136, an upper path switching member 118 will be in a state shown by the dashed line in the drawing by a driving unit, such as a solenoid, not shown. Thereby, the sheet is guided to an upper conveyance path 117, and discharged onto the upper tray 136 via an upper sheet discharge roller pair 120, i.e., discharge rotary member pair. When the sheet is not discharged onto the upper tray 136, the sheet conveyed via the buffer roller pair 115 is guided via the upper path switching member 118 in the state shown by the solid line to a bundle conveyance path 121. Thereafter, the sheet is passed sequentially through the conveyance path via a conveyance roller 122 and a bundle conveyance roller pair 124.

Next, when discharging the conveyed sheet to the lower tray 137 disposed at a lower portion, the sheet is conveyed to a lower path 126 via the saddle path switching member 125 in a state shown by the solid line. Thereafter, the sheet is conveyed sequentially via a lower sheet discharge roller pair 128 constituting a sheet conveyance unit to an intermediate processing tray 138, i.e., support tray. Then, the conveyed sheet is supported and aligned sequentially by a paddle 131, a belt roller 158 and the like, and a predetermined number of sheets are subjected to an alignment process on an intermediate processing tray 138 subjecting the aligned and supported sheet bundle to processing.

The bundle of sheets subjected to alignment process on the intermediate processing tray 138 is subjected to a binding process by a stapler 132 composing a stapled portion as needed, and thereafter, discharged onto the lower tray 137 via a sheet bundle discharge roller pair 130. The stapler 132 can move freely in a width direction (hereinafter referred to as a depth direction) orthogonal to a sheet conveyance direction, and subject multiple areas on an upstream end of the bundle of sheets to a binding process.

On the other hand, when the sheets are subjected to a saddle (saddle stitch) processing, the saddle path switching member 125 is moved to a position illustrated by the dashed line via a driving unit such as a solenoid not shown. Thereby, the sheets are conveyed to a saddle path 133 and guided to the saddle unit 135 via a saddle inlet roller pair 134, where they are subjected to saddle processing (saddle stitch binding process).

As shown in FIG. 2, an inserter 100B is provided on an upper portion of the finisher 100. The inserter 100B is for inserting a sheet, i.e., an insert sheet, that differs from a normal sheet, to a first page or a final page of the sheet bundle, or among sheets having images formed thereto in the copying machine body 602.

The inserter 100B is for conveying the insert sheet set to an insert tray 140 or 141 to the upper tray 136, the intermediate processing tray 138 or the saddle unit 135, without passing through the copying machine body 602. When the insert sheet is inserted by the inserter 100B into the bundle of sheets having images formed thereto, the insert sheet set to the insert tray 140 or 141 is fed via a pickup roller 142 or 143.

Then, the insert sheet is conveyed via conveyance rollers 144, 145, 147 and 148, and merged with a sheet conveyed from the copying machine body 602 at an upstream side of the conveyance roller 110 and the separation roller 111 of the finisher 100. Thereafter, the insert sheet is conveyed to any one of the upper tray 136, the intermediate processing tray 138 or the saddle unit 135, similar to the sheets discharged from the copying machine body 602.

Width-direction alignment members 1, i.e., alignment units, are respectively provided above the upper tray 136 and the lower tray 137, and the width-direction alignment members 1 align the positions of the sheets supported on the upper tray 136 and the lower tray 137 in a width-direction orthogonal to a sheet discharge direction.

Figure 3A:
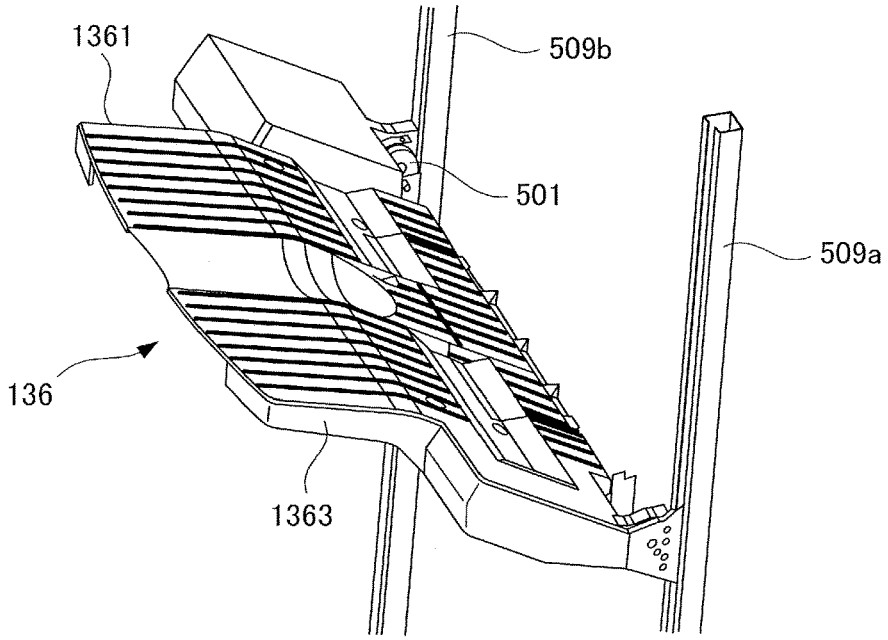
FIG. 3A is a first perspective view of an upper tray provided on the finisher.
Figure 3B:
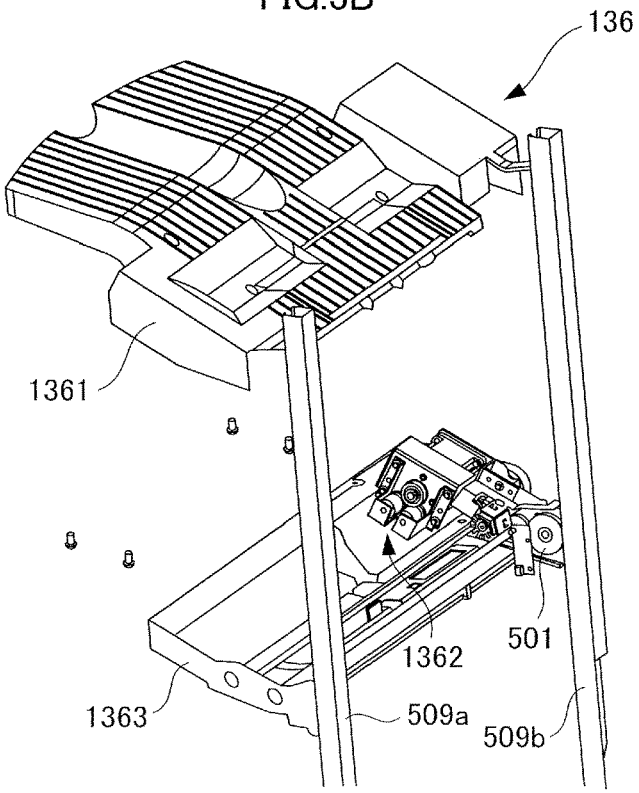
FIG. 3B is a second perspective view of the upper tray provided on the finisher.

Further, the upper tray 136 and the lower tray 137 can be moved up and down with respect to the upper sheet discharge roller pair 120. FIGS. 3A and 3B is a view illustrating a configuration of the upper tray 136. The lower tray 137 adopts a similar configuration as the upper tray 136, so that the lower tray 137 will not be described. As illustrated in FIG. 3A, the upper tray 136 is moved up and down along a pair of racks 509*a* and 509*b* provided on a finisher body 400 and extending in a vertical direction. Further, as illustrated in FIG. 3B, the upper tray 136 includes a support unit 1361 on which sheets are supported, and a body unit 1363 on which an elevation unit 1362 having a pinion gear 501 engaged with racks 509*a* and 509*b* and elevating the upper tray 136 is arranged.

Figure 4A:
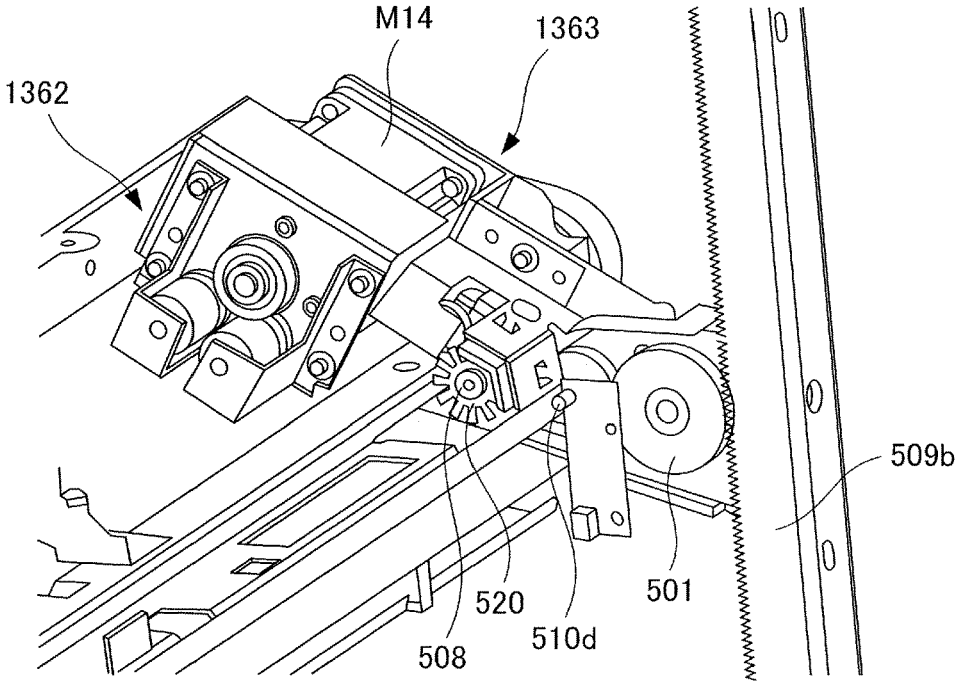
FIG. 4A is a first perspective view of an elevation unit.
Figure 4B:
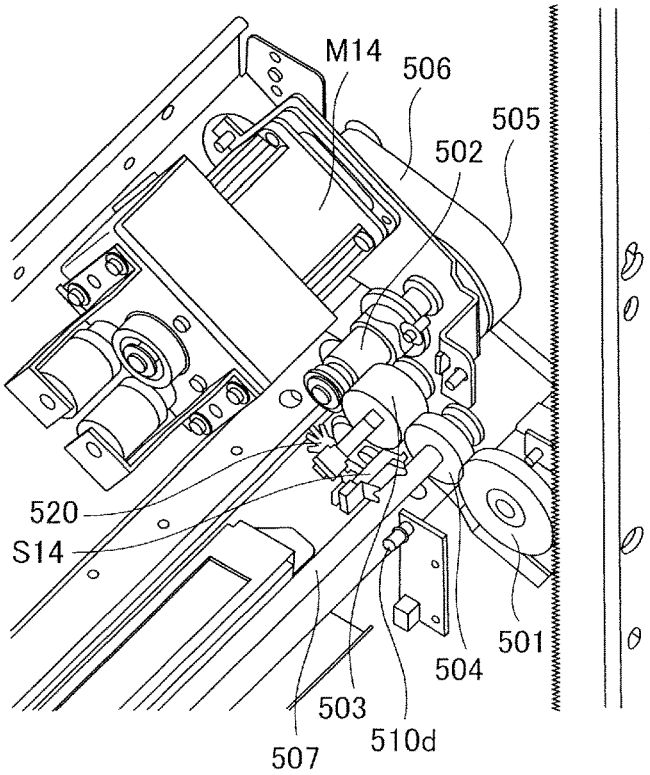
FIG. 4B is a second perspective view of an elevation unit.

The elevation unit 1362 includes a tray elevation motor M14, as illustrated in FIGS. 4A and 4B. The drive of the tray elevation motor M14 is transmitted via an elevation belt 506, an elevation pulley 505, a first elevation gear 502, a second elevation gear 503 and a third elevation gear 504 to the pinion gear 501. The body unit 1363 is arranged to oppose to the pinion gear 501, and a pinion gear not shown engaged with the rack 509*a* is provided, wherein the pinion gear not shown and the pinion gear 501 are provided on both ends of an elevation shaft 507. In this arrangement, when the pinion gear 501 is rotated by the tray elevation motor M14, the pinion gear not shown rotates in synchronization with the pinion gear 501, and the rotation of the two pinion gears 501 elevates the upper tray 136.

Figure 5:
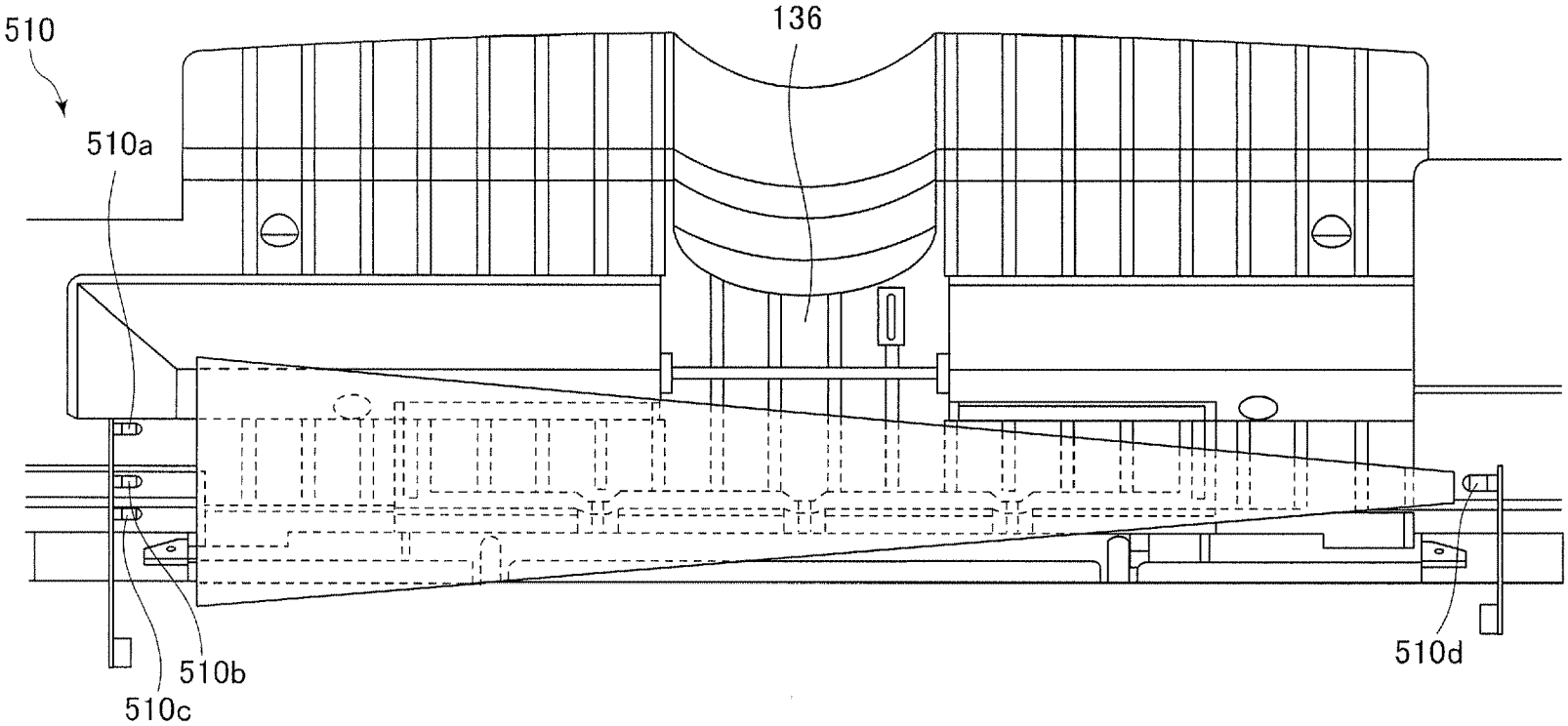
FIG. 5 is a side view of a height detection unit provided on the finisher.

In the present embodiment, as illustrated in FIG. 5, the finisher 100 includes a height detection unit 510 detecting a sheet supporting surface of the upper tray 136 and an uppermost surface of the bundle of sheets. The sheet height detection unit 510 is composed of a first detection unit 510*a*, a second detection unit 510*b* and a third detection unit 510*c* arranged vertically, and a light emitting member 510*d* emitting light to the respective detection units 510*a* through

510*c*. In the present embodiment, the first detection unit 510*a* is positioned at the highest position, and the third detection unit 510*c* is positioned at the lowest position.

The respective detection units 510*a* through 510*c* detect whether light from the light emitting member 510*d* has been received, by turning ON and OFF. At this time, before the job is started, that is, when there are no sheets placed on the upper tray, only the third detection unit 510*c* at the lowest position is shaded by the upper tray 136 and turned ON. If the third detection unit 510*c* is set to an OFF state before the job is started, that is, if the upper tray 136 is at a lower position than the initial height, a tray elevation motor M14 is activated, and the upper tray 136 is elevated until the third detection unit 510*c* is turned ON.

If the first and second detection units 510*a* and 510*b* are turned ON before the job is started, that is, if sheets are supported on the upper tray 136, the tray elevation motor M14 is driven in a reverse direction, and the upper tray 136 is lowered until the second detection unit 510*b* is turned OFF. In this case, the third detection unit 510*c* is shaded by the sheets placed on the upper tray 136 and turned ON. Thereby, the initial height of the upper tray 136 corresponding to a case where there are no sheets placed on the upper tray and a case where sheets are supported on the upper tray can be determined.

Thereafter, when the job is started and the sheets are sequentially supported, the second detection unit 510*b* is shaded by the sheets and turned ON. When the second detection unit 510*b* is turned ON, the tray elevation motor M14 is driven in the reverse direction, and the upper tray 136 is lowered until the second detection unit 510*b* is turned OFF. Thereafter, when sheets are further supported and the second detection unit 510*b* turns ON again, the upper tray 136 is lowered. By repeating this operation, the sheets can be supported sequentially on the upper tray 136.

As illustrated in FIGS. 4A and 4B described above, an encoder 520 is attached to a shaft 508 of the first elevation gear 502. An amount of rotation of the tray elevation motor M14, that is, the amount of lowering of the upper tray 136, is detected by having the rotation of the encoder 520 detected by a position detecting sensor S14, and the amount of lowering of the upper tray 136 from an initial position when the job has been started is detected. The tray positioning control prior to starting the job, the control of gradually lowering the upper tray 136 during the job, and the detection control of the lowering amount of the tray similarly apply to the lower tray 137.

Figure 6:
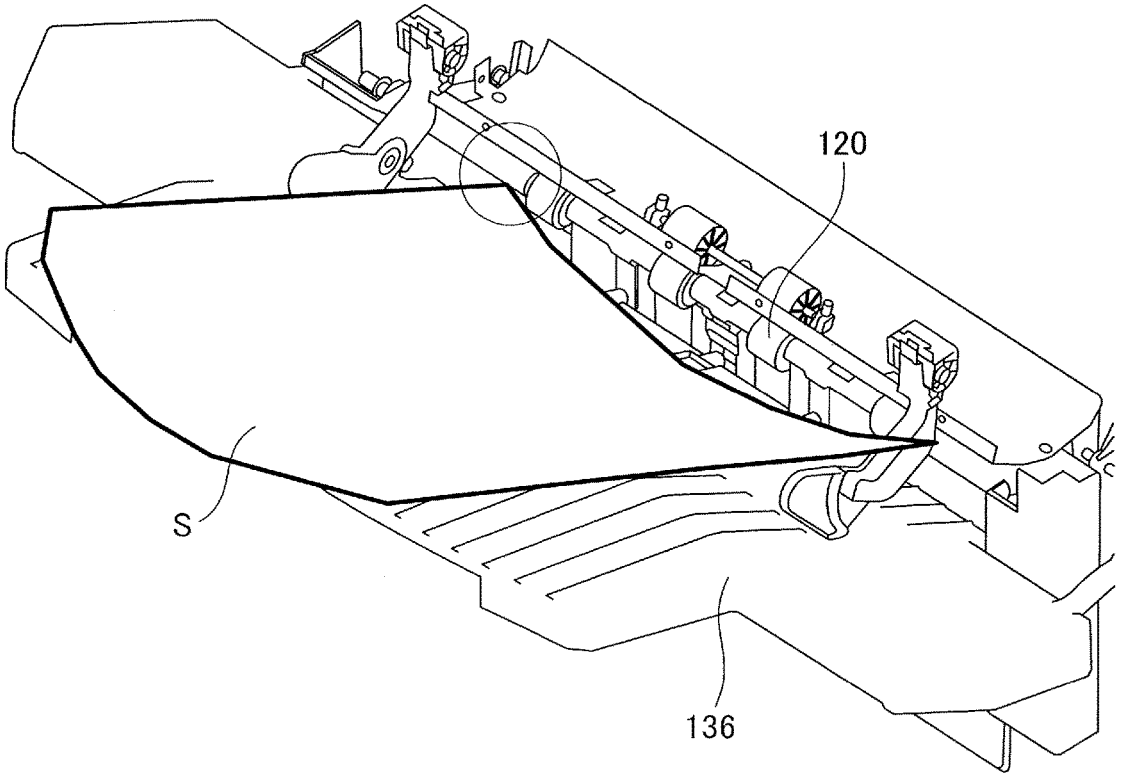
FIG. 6 is a perspective view of a state in which a curled sheet is discharged on the upper tray.

FIG. 6 illustrates a state in which the sheet S is discharged onto the upper tray 136 with both end portions in a width direction of the sheet S curled upward. When a sheet curled in this manner is discharged onto the upper tray 136, the curled upstream end of the sheet leans against the upper sheet discharge roller pair 120 at the area shown by the circle, possibly causing deterioration of support performance, or falling or jamming of the sheet by colliding with a leading end of a subsequent sheet.

Therefore, according to the present embodiment, the upper tray 136 includes a first support surface 136*a* inclined for inclination angle θ1 with respect to a horizontal plane to prevent falling and the like of the sheet having curled ends. Further, the upper tray 136 includes a second support surface 136*b* provided downstream in a sheet discharge direction of the first support surface 136*a*, and inclined for inclination angle θ2 having a smaller angle than the inclination angle θ1 of the first support surface 136*a* with respect to the horizontal plane. That is, the upper tray 136 has a bent sheet supporting surface 136*c* having two support surfaces 136*a* and 136*b* inclined by different inclination angles θ1 and θ2. A bend point 136*d* of the sheet supporting surface 136*c* is formed at a boundary between the two support surfaces 136*a* and 136*b*. In the present embodiment, for example, the inclination angle θ1 is set to approximately 30 degrees, and the inclination angle θ2 is approximately set to 15 degrees.

Figure 7A:
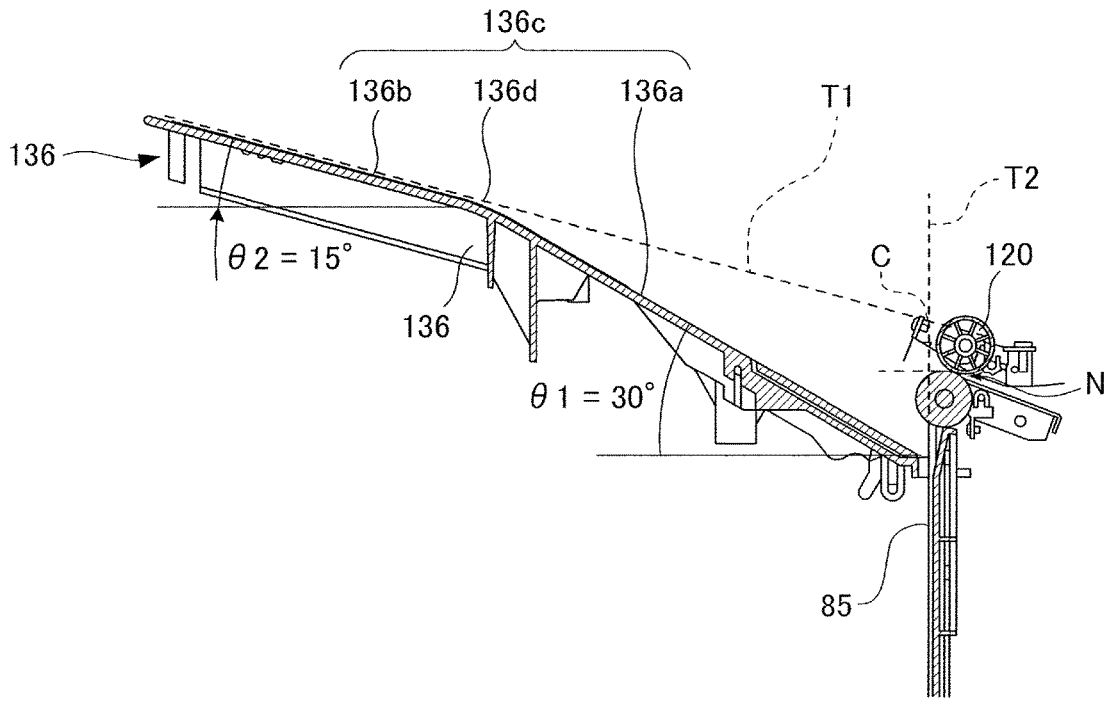
FIG. 7A is a front view of a state in which the upper tray is positioned at a first position.
Figure 7B:
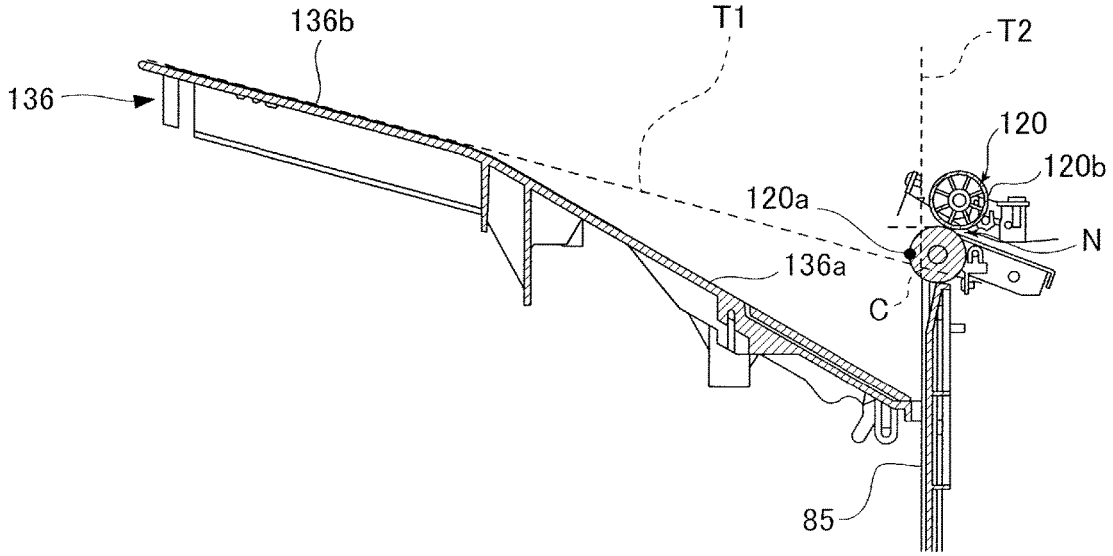
FIG. 7B is a front view of a state in which the upper tray is positioned at a second position.

According to the present embodiment, images are formed on normal sheets having a stiffness that is smaller than a given stiffness, and high stiffness sheets having a stiffness that is equal to or greater than a predetermined stiffness. A standby position of the upper tray 136 is changed in accordance with the sheet being used. FIG. 7A illustrates a state where the upper tray 136 is at a first position, which is a standby position for supporting normal sheets. Further, FIG. 7B illustrates a state where the upper tray 136 is at a second position, which is a standby position for supporting sheets having high stiffness. In the present embodiment, the second position is a position 40 mm lower than the first position. The third detection unit 510*c* detects that the upper tray 136 is at the first position, and the second detection unit 510*b* detects that the upper tray 136 is at the second position.

The first position is a position where the first detection unit 510*a* and the second detection unit 510*b* described above are set to OFF and the third detection unit 510*c* is set to ON. At this position, as illustrated in FIG. 7A, an intersection C of an extension line T1 of the second support surface 136*b* and an extension line T2 of an abutment member 85 is positioned higher than a nip N of the upper sheet discharge roller pair 120.

On the other hand, the second position is a position approximately 40 mm lower than the first position. When the upper tray 136 is positioned at the second position, as shown in FIG. 7B, the intersection C of the extension line T1 of the second support surface 136*b* and the extension line T2 of the abutment member 85 is positioned lower than a nip N of the upper sheet discharge roller pair 120. Further, the upper sheet discharge roller pair 120 has an upper roller 120*b* provided on an upper side, and a lower roller 120*a* positioned below the upper roller 120*b*. When the upper tray 136 is positioned at the second position, the intersection C is positioned somewhat lower than a downstream end of the lower roller 120*a* in the sheet discharge direction. Then, the CPU circuit unit 630 changes a height of the upper tray 136 at the time of discharge of the sheet to the position illustrated in FIG. 7A or FIG. 7B, in accordance with the sheet type.

Figure 8A:
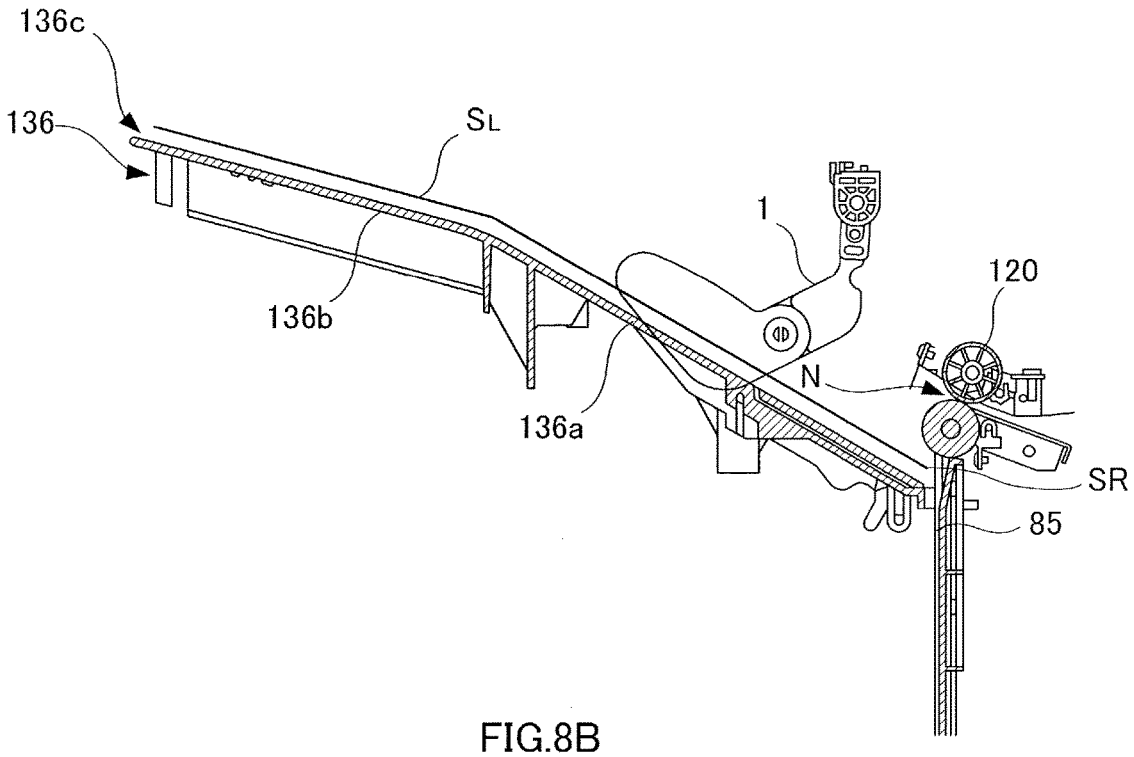
FIG. 8A is a front view of a state in which a sheet having a low stiffness is discharged on the upper tray.
Figure 8B:
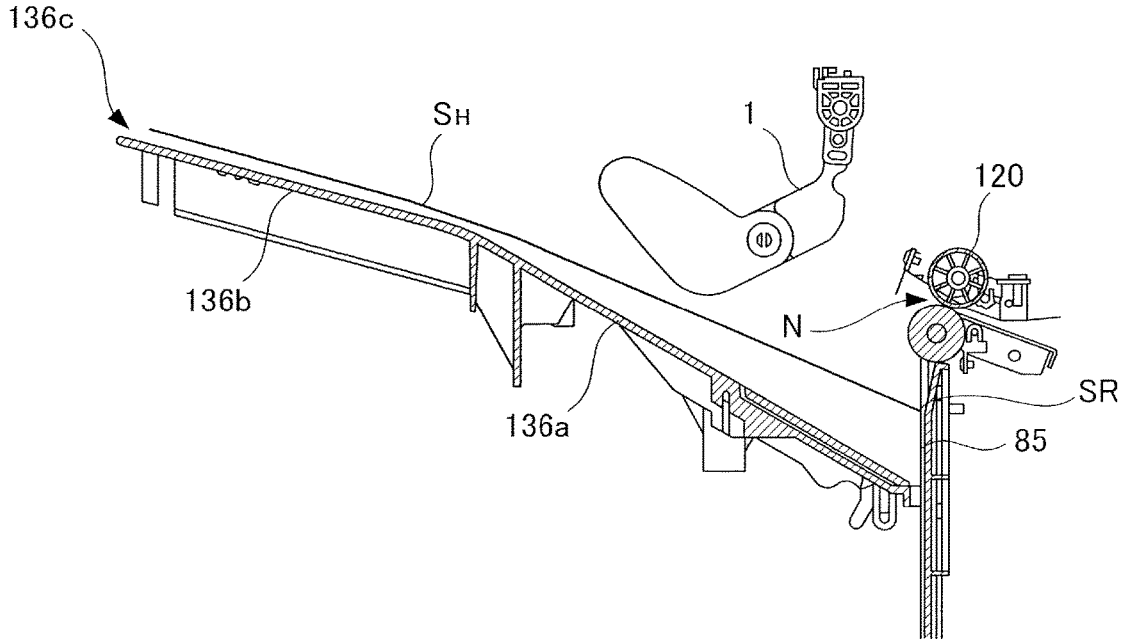
FIG. 8B is a front view of a state in which a sheet having a high stiffness is discharged on the upper tray.

FIG. 8A is a view illustrating a state where a sheet $S_L$ having a low stiffness is discharged to an upper tray 136 having a curved sheet supporting surface 136*c*. In this case, the upper tray 136 is positioned at the first position, and the sheet $S_L$ is supported on both the first and second support surfaces 136*a* and 136*b*. In this state, the sheet $S_L$ follows the curvature of the first support surface 136*a* and the second support surface 136*b*, so that an upstream end SR of the sheet in the sheet discharge direction abuts against the abutment member 85 (abutment surface). Further, FIG. 8B is a view illustrating a state where a sheet having a high stiffness is discharged onto the upper tray 136. In this case, the upper tray 136 is positioned at the second position, and at this time, a sheet $S_H$ having a high stiffness is supported on the second support surface 136*b*, and an upstream end SR in the sheet discharge direction abuts against the abutment member 85 without leaning against the upper sheet discharge roller pair 120.

In the present embodiment, when the upper tray 136 is positioned at the first position, as illustrated in FIG. 7A described above, the intersection C of the extension line T1 of the second support surface 136*b* and the extension line T2 of the abutment member 85 is positioned either level with or higher than the nip N of the upper sheet discharge roller pair 120. Moreover, when the upper tray 136 is positioned at the second position, as illustrated in FIG. 8B described above, the intersection C is positioned lower than the nip N of the upper sheet discharge roller pair 120.

Figure 9A:
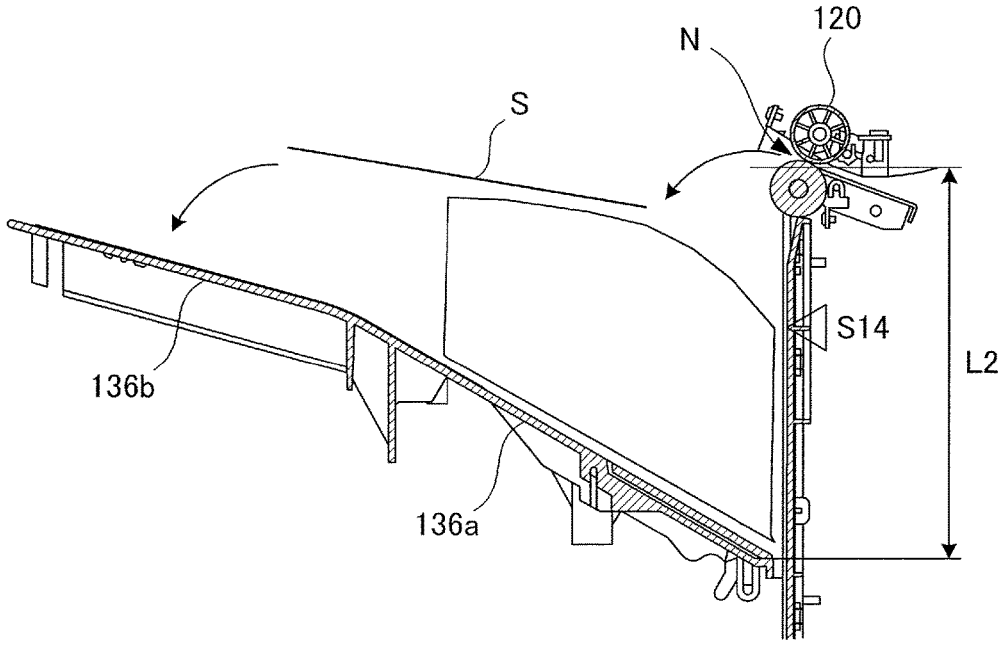
FIG. 9A is a view illustrating a state of discharge of a sheet when the upper tray is positioned at a low position.
Figure 9B:
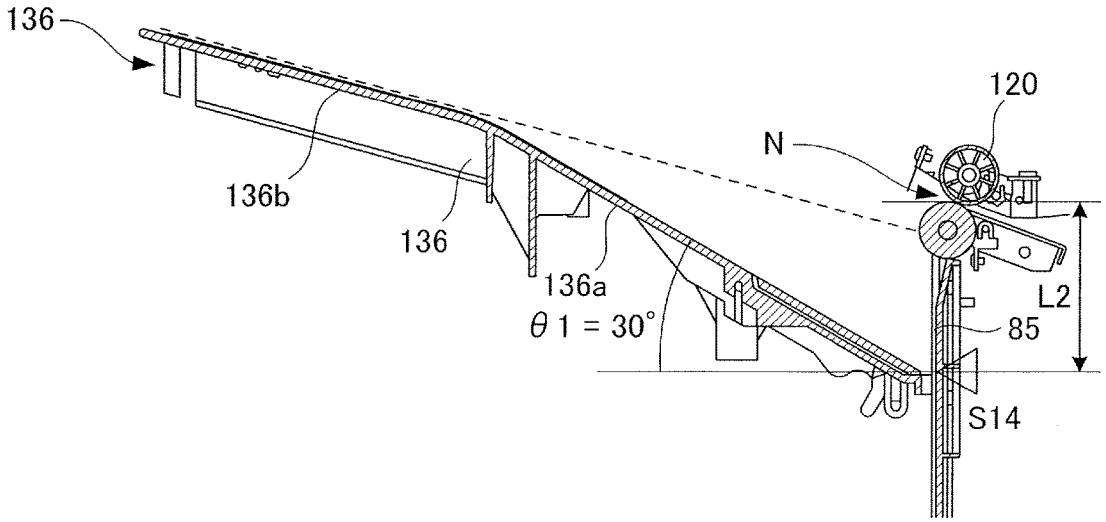
FIG. 9B is a view illustrating a state of discharge of a sheet when the upper tray is positioned at a position that is not low.

Next, the first and second positions described above will be described. The distance between the upper sheet discharge roller pair 120 and the tray or the angle of the tray is extremely important with respect to the discharge performance and support performance. For example, if a distance L2 between the nip N of the upper sheet discharge roller pair 120 and the upper tray 136 is long, as illustrated in FIG. 9A, a landing spot of the discharged sheet S will be far, and the sheet S may fall off from the downstream side instead of returning toward the abutment member 85. Therefore, according to the present embodiment, the distance L2 is set to approximately 40 mm so that the discharged sheet S is returned toward the abutment member 85, as illustrated in FIG. 9B.

Figure 10A:
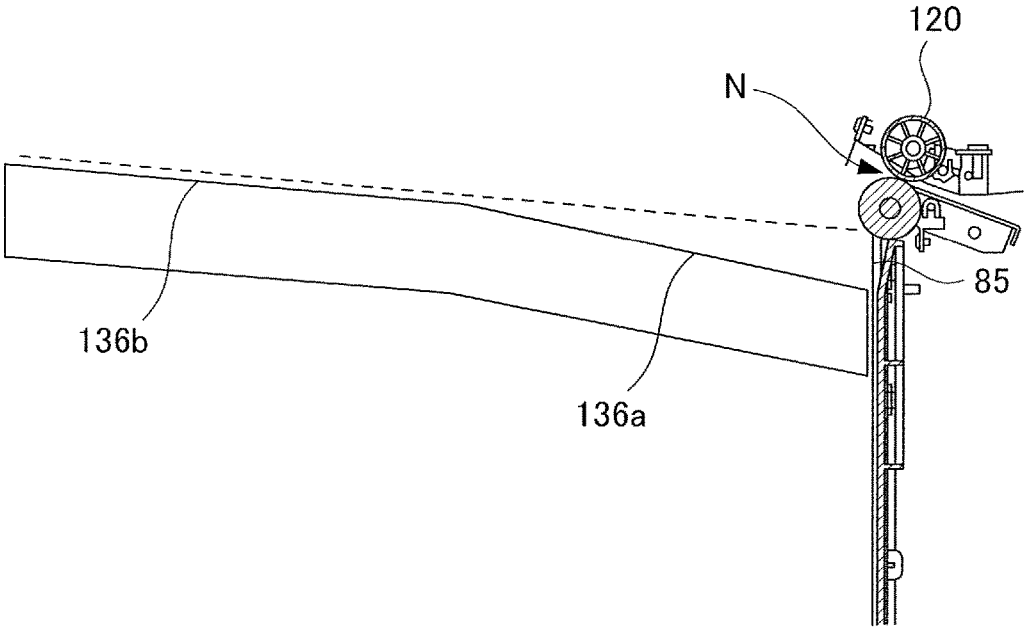
FIG. 10A is a front view of an upper tray having a first support surface of the upper tray arranged at an angle close to a horizontal level.
Figure 10B:
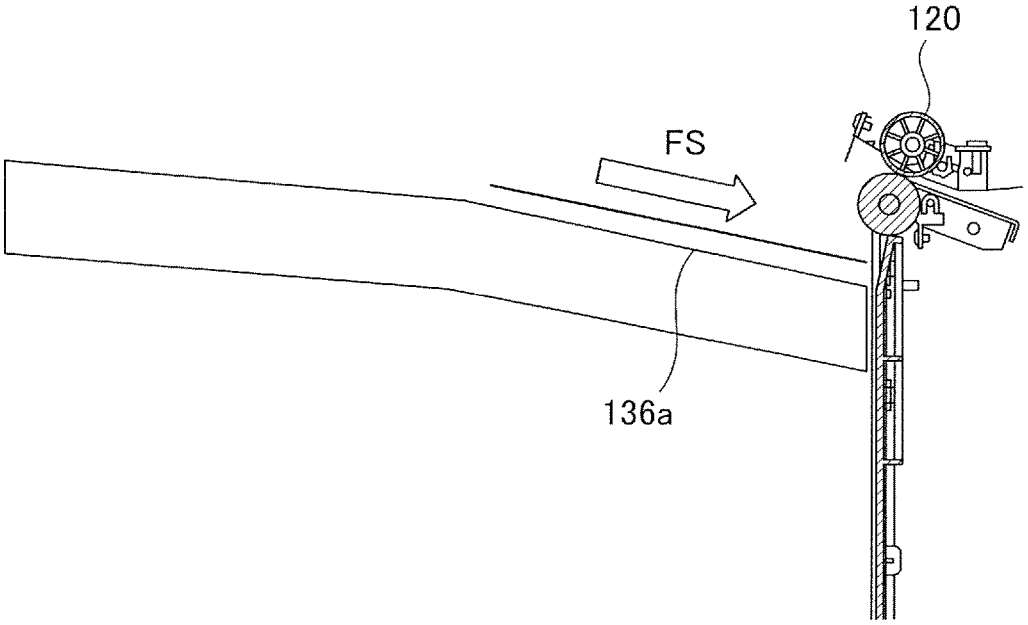
FIG. 10B illustrates a return force of a sheet by its own weight.
Figure 11:
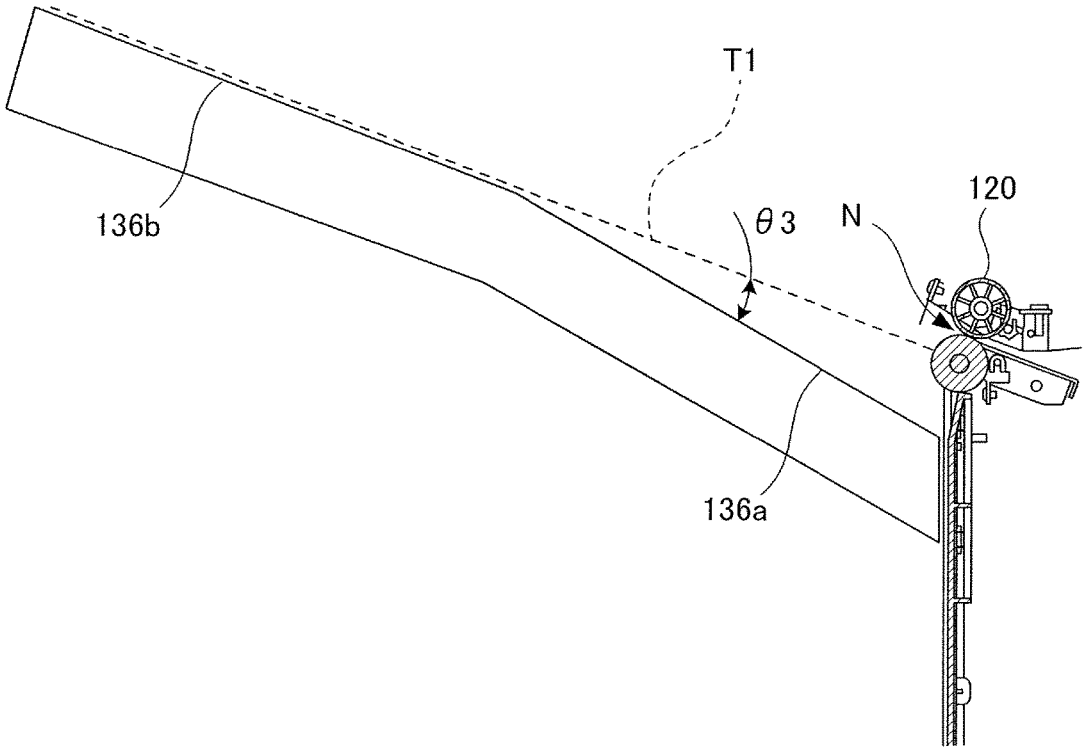
FIG. 11 is a front view of an upper tray in which an angle formed by the first support surface and the second support surface is small.

If the first support surface 136*a* is set to an angle close to a horizontal level, as illustrated in FIG. 10A, a return force FS by an own weight of the sheet illustrated in FIG. 10B becomes small, and the discharged sheet falls from the downstream side instead of returning toward the abutment member 85, similar to the state described in FIG. 9A. Further, if the angle θ3 between the first and second support surfaces 136*a* and 136*b* as shown in FIG. 11 is small, the extension line T1 of the second support surface 136*b* becomes lower than the nip N of upper sheet discharge roller pair 120. However, in that case, a curl of a normal sheet cannot be cancelled, and the upstream end SR of the sheet will lean against the upper sheet discharge roller pair 120.

As described above, if the sheet is received by the upper tray in the lowered state, the landing spot of the discharged sheet on the tray will be far, and the sheet will fall off from the downstream side, or even if the first support surface 136*a* of the tray is set close to the horizontal level, the return force FS by the own weight of the sheet is reduced and the sheet will fall off from the downstream side. Further, if the angle θ3 between the first support surface and the second support surface is set small, a curl of a normal sheet cannot be cancelled.

Therefore, according to the present embodiment, the distance L2 in a state where the upper tray 136 is positioned at the first position is set to approximately 40 mm. Further, the angle θ1 of the first support surface 136*a* with respect to a horizontal surface is set to such an angle where the return force FS by the own weight of the sheet causes the sheet to return toward the abutment member 85, and the angle θ3 formed between the first support surface and the second support surface is set to such an angle capable of cancelling the curvature of the sheet. When the arrangement is designed in this manner, the extension line of the second support surface 136*b* becomes necessarily higher than the nip N of the upper sheet discharge roller pair 120. Therefore, when discharging a normal sheet, prior to discharging the sheet, the upper tray is moved to the first position which is at the upper position where the intersection C of the extension line T1 of the second support surface 136*b* and the extension line T2 of the abutment member 85 is positioned either level with or higher than the nip N of the upper sheet discharge roller pair 120.

Figure 17:
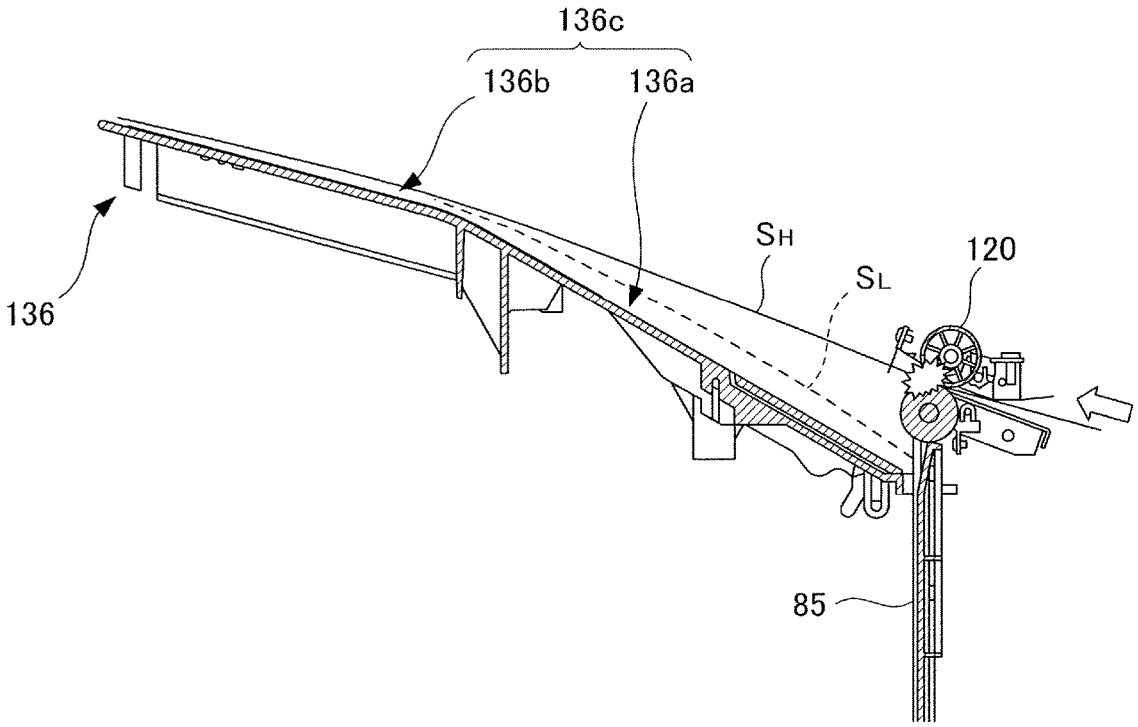
FIG. 17 is a front view of a state in which a sheet having a high stiffness supported on the upper tray is abutted against an upper sheet discharge roller pair.

On the other hand, when discharging a sheet $S_H$ having a high stiffness, as illustrated in FIG. 17, a leading end portion of the sheet $S_H$ is supported by the second support surface 136*b*, and even though an upstream end of the sheet $S_H$ is sagged somewhat downward by its own weight, the sheet will not be deformed along the first support surface 136*a* since it has high stiffness. If the sheet is discharged in a state where the intersection C is positioned higher than the nip N, the upstream end SR of the sheet may lean against the upper sheet discharge roller pair 120. The sheet $S_H$ collides against the leading end of the subsequent sheet and is pushed by the sheet, by which falling or jamming of the sheet may occur. This phenomenon will not occur in sheets having a basis weight of approximately 300 g/m$^2$, since the stiffness of the sheets is not high, but it may occur in sheets with a high stiffness having a basis weight of approximately 350 g/m$^2$ to 400 g/m$^2$, or in high stiffness films.

Therefore, the upper tray 136 must be lowered to a position lower than the nip N before discharging the sheets. Therefore, when discharging a sheet having a high stiffness, the upper tray must be moved to a second position, which is a lower position where the extension line T1 of the second support surface 136*b* is positioned lower than the nip N of the upper sheet discharge roller pair 120, before discharging the sheet.

Figure 12:
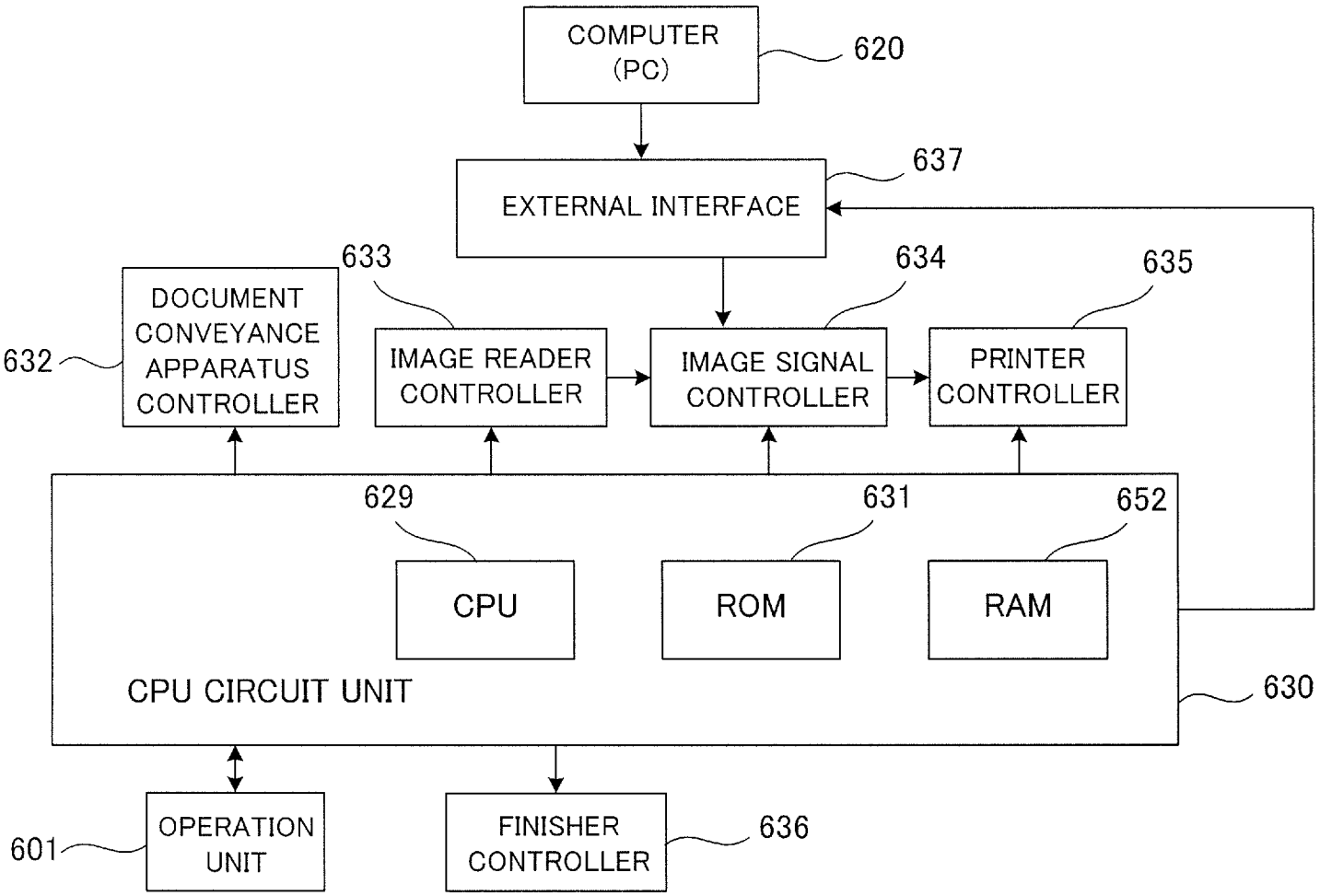
FIG. 12 is a control block diagram of the black-and-white/color copying machine.

FIG. 12 is a control block diagram of the black-and-white/color copying machine 600. The CPU circuit unit 630 includes a CPU 629, a ROM 631 storing control programs and the like, and a RAM 652 used as an area for temporarily storing control data or an operation area for performing computation accompanying the control. Further, the black-and-white/color copying machine 600 is provided with an external interface 637 capable of connecting the CPU circuit unit 630 with an external computer (PC) 620. When the external interface 637 receives a print data from an external computer 620, it develops the data into a bitmap image, and outputs the image as image data to an image signal controller 634.

Thereafter, the image signal controller 634 outputs the data to a printer controller 635, and the printer controller 635 outputs the data from the image signal controller 634 to an exposure controller not shown. A document image read by the image sensor 650*a* (refer to FIG. 1) is output from an image reader controller 633 to the image signal controller 634, and the image signal controller 634 outputs the image to the printer controller 635.

The operation unit 601 further includes a plurality of keys for setting various functions related to image forming, a display unit for displaying the set state, and so on. Key signals corresponding to the operation of respective keys by the user are output to the CPU circuit unit 630, and corresponding information is displayed on the display unit based on the signals from the CPU circuit unit 630.

The CPU circuit unit 630 controls the image signal controller 634 by a control program stored in the ROM 631 and the setting the operation unit 601, and controls the document conveyance apparatus 651 (refer to FIG. 1) via a document conveyance apparatus controller 632. Moreover, the CPU circuit unit 630 controls the document reading unit 650 (refer to FIG. 1) via the image reader controller 633, the image forming unit 603 (refer to FIG. 1) via the printer controller 635, and the finisher 100 via a finisher controller 636.

In the present embodiment, the finisher controller 636, i.e., controller, is installed in the finisher 100, and performs drive control of the finisher 100 by communicating information with the CPU circuit unit 630. The finisher controller 636 can also be provided integrally with the CPU circuit unit 630 on the copying machine body, to control the finisher 100 directly from the copying machine body side.

Figure 13:
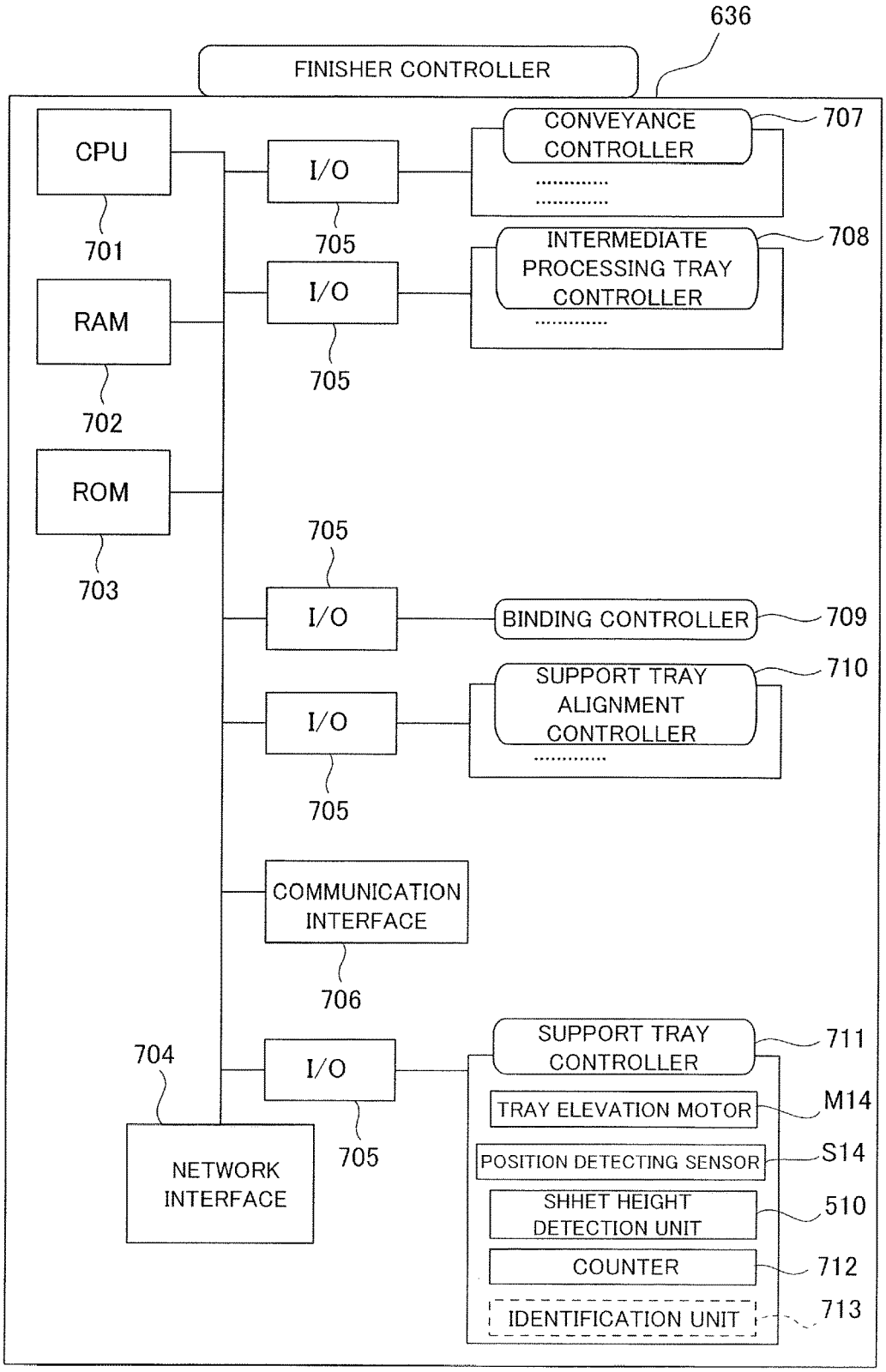
FIG. 13 is a control block diagram of the finisher.

FIG. 13 is a control block diagram of the finisher 100 according to the present embodiment. The finisher controller 636 is composed of a CPU (microcomputer) 701, a RAM 702, a ROM 703, an input/output unit (I/O) 705, a communication interface 706, a network interface 704, and so on. Further, the input/output unit (I/O) 705 has a conveyance controller 707, an intermediate processing tray controller 708, a binding controller 709, a support tray alignment controller 710 and a support tray controller 711 coupled thereto.

The conveyance controller 707 performs a sheet lateral registration detecting process, a sheet buffering process, and a conveyance process. The intermediate processing tray controller 708 performs drive control of the paddle 131, the upper sheet discharge roller pair 120, and so on. Further, the binding controller 709 performs drive control of the stapler 132 and so on, and the support tray alignment controller 710 performs drive control of the width-direction alignment member 1. The support tray controller 711 has the sheet height detection unit 510, the position detecting sensor S14 and the tray elevation motor M14 connected thereto, and the support tray controller 711 controls the tray elevation motor M14 based on the signals from the position detecting sensor S14. The support tray controller 711 has a counter 712 connected thereto for counting the number of sheets being discharged, and the support tray controller 711 controls the tray elevation motor M14 based on a count information from the counter 712.

Figure 14:
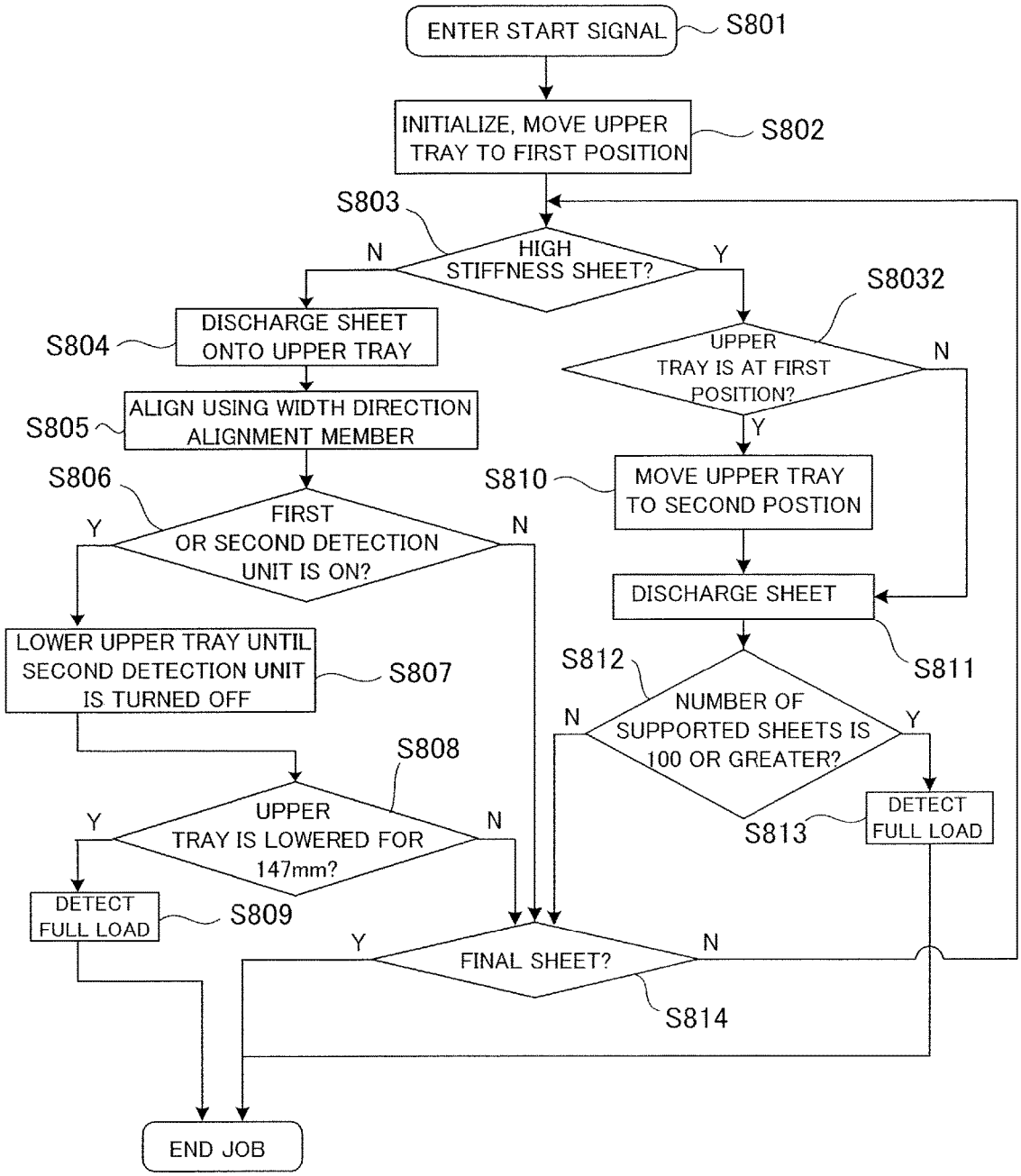
FIG. 14 is a flowchart illustrating an operation in which a sheet is discharged and supported on the upper tray.

Next, an operation for sequentially discharging the sheet having an image formed thereto in the black-and-white/color copying machine 600 from the finisher 100 onto the upper tray 136, and supporting the sheet on the tray, will be described with reference to the flowchart illustrated in FIG. 14. In the present embodiment, a super-thick sheet having a high stiffness is discharged only onto the upper tray 136 due to the curvature rate of the conveyance path or the conveyance force of the conveyance member, but the sheet can also be discharged onto both the upper tray 136 and the lower tray 137.

When a start signal is entered from the operation unit 601 of the black-and-white/color copying machine 600 (step S801), the finisher controller 636 initializes the respective members, and moves the upper tray 136 to a first position where only the third detection unit 510*c* is turned ON (step S802). Next, the finisher controller 636 determines whether the sheet is a high-stiffness sheet, based on a sheet information, i.e., stiffness information, such as a basis weight, sent from the operation unit 601, i.e., stiffness information input unit (step S803). If the sheet is not a high-stiffness sheet (step S803: N), but is a sheet having a low stiffness, that is, a normal sheet having a stiffness smaller than a predetermined stiffness, i.e., a first sheet, the finisher controller 636 is set to a first discharge mode. In the first discharge mode, the sheet is discharged onto the upper tray 136 in a state where the upper tray 136 is still positioned at the first position (step S804). Even when the sheet is curled at this time, as illustrated in FIG. 8A described earlier, the sheet $S_L$ follows the curvature of the first support surface 136*a* and the second support surface 136*b*, and the upstream end SR of the sheet abuts against the abutment member 85 without leaning against the upper sheet discharge roller pair 120. Thereafter, the sheet is aligned via the width-direction alignment member 1 (step S805), and the width direction of the sheet is aligned.

Next, the finisher controller 636 confirms whether the first detection unit 510*a* or the second detection unit 510*b* is set to ON (step S806). If the first detection unit 510*a* or the second detection unit 510*b* is set to OFF (step S806: N), the subsequent sheet is received in that state. If the first detection unit 510*a* or the second detection unit 510*b* is set to ON (step S806: Y), the finisher controller 636 drives the tray elevation motor M14 in the opposite direction, and lowers the upper tray 136 until the second detection unit 510*b* is turned OFF (step S807). When the upper tray 136 is lowered, the lowering amount of the tray is measured by a tray position detecting sensor S13, as described earlier, and whether the tray has been lowered for a total of 147 mm or greater is confirmed (step S808).

If the upper tray 136 has been lowered for 147 mm or greater (step S808: Y), the tray cannot be lowered any further due to the design of the present apparatus, so that the sensor detects full load (step S809), which is notified to the CPU circuit unit 630, and the job is ended. In the present embodiment, the lowering amount of the upper tray 136 is detected to thereby detect the height position of the upper tray 136 and detect full load of the sheets, but it is also possible to perform control to provide a lower limit sensor close to a lower limit of the upper tray 136, and to detect full load when the lower limit sensor is turned ON.

If the lowering amount of the upper tray 136 is equal to or smaller than 147 mm (step S808: N), that is, if the tray is not in a fully-loaded state, or if the first detection unit 510*a* or the second detection unit 510*b* is set to OFF (step S806: N), the finisher controller 636 determines whether the discharged sheet is a final sheet (step S814). If the sheet is not a final sheet (step S814: N), the discharge and alignment of a subsequent sheet to the upper tray 136 and confirmation/lowering of the tray height are repeatedly performed. Thereafter, when the finisher controller 636 determines that the sheet discharged onto the upper tray 136 is a final sheet (step S814: Y), the job is ended.

On the other hand, if the sheet has a high stiffness, that is, if the sheet has a stiffness equal to or greater than a predetermined stiffness, i.e., a second sheet (step S803: Y), the finisher controller 636 is set to a second discharge mode. In the second discharge mode, the finisher controller 636 confirms whether the upper tray 136 is at the first position, before discharging the sheet onto the upper tray 136 (step S8032). Then, if the upper tray 136 is at a first position (step S8032: Y), the finisher controller 636 lowers the upper tray 136 for 40 mm and moves the tray to a second position where the second detection unit 510*b* is turned on (step S810). Thereafter, the sheet having a high stiffness is discharged onto the upper tray 136 (step S811).

Now, as illustrated in FIG. 8B described earlier, the second position is set to such a height where even a sheet $S_H$ having a high stiffness abuts against the abutment member 85 without having the upstream end SR lean against the upper sheet discharge roller pair 120. Therefore, even the sheet $S_H$ having a high stiffness can abut against the abutment member 85 without having the upstream end SR lean against the upper sheet discharge roller pair 120.

According to the present embodiment, in a state where the upper tray 136 is positioned at the second position, as illustrated in FIG. 8B, the sheet $S_H$ will not overlap with the width-direction alignment member 1. In that case, since the alignment operation by the width-direction alignment member 1 cannot be performed, the alignment operation by the width-direction alignment member 1 will not be performed after discharging the high-stiffness sheet $S_H$. If the lowering amount of the upper tray 136 is set to approximately 15 mm, for example, alignment operation by the width-direction alignment member 1 can be performed.

When a high stiffness sheet $S_H$ is discharged, the sheet surface height detection control by the first and second detection units 510*a* and 510*b* as in step S806 described earlier will not be performed. When the first and second detection units 510*a* and 510*b* are turned on, it means that the upper tray 136 is positioned close to the first position, and that it is highly possible that the upstream end SR of the sheet having a high stiffness will lean against the upper sheet discharge roller pair 120. Therefore, according to the present embodiment, the number of sheets discharged onto the upper tray 136 is counted by the counter 712, and whether the number of supported sheets may cause the first and second detection units to turn ON, such as whether the number of supported sheets is 100 or greater, is determined (step S812). If the number of supported sheets is not 100 or greater (step S812: N), whether the discharged sheet is a final sheet is determined (step S814). If the number of supported sheets is 100 or greater (step S812: Y), the procedure detects full load (step S813), which is notified to the CPU circuit unit 630, and the job is ended.

As described, according to the present embodiment, when a sheet having a low stiffness, such as a normal sheet, is discharged, the sheet is supported in a state where the upper tray 136 is positioned at the first position, and when a sheet having a high stiffness, such as a super-thick paper, is discharged, the upper tray 136 is positioned at the second position. In other words, according to the present embodiment, in the case of a sheet having a low stiffness where the discharged sheet is supported on both the first and second support surfaces 136*a* and 136*b*, the upper tray 136 is controlled to be positioned at the first position before the sheet is discharged.

Further, if the sheet is a high stiffness sheet supported only by the second support surface 136*b*, the upper tray 136 is controlled to be positioned at the second position before the sheet is discharged. If the sheet having a high stiffness is supported in this manner, the high stiffness sheet can be discharged and supported without the upstream end SR of the sheet leaning against the upper sheet discharge roller pair 120 and colliding with the subsequent sheet by having the upper tray 136 positioned at the second position.

As described, according to the present embodiment, the height position of the upper tray 136 is changed in accordance with the stiffness of the sheet discharged onto the upper tray 136. Thereby, a satisfactory supporting performance of a normal sheet and a super-thick sheet can be obtained, so that a curled sheet can be supported stably regardless of the stiffness of the sheet.

Figure 15:
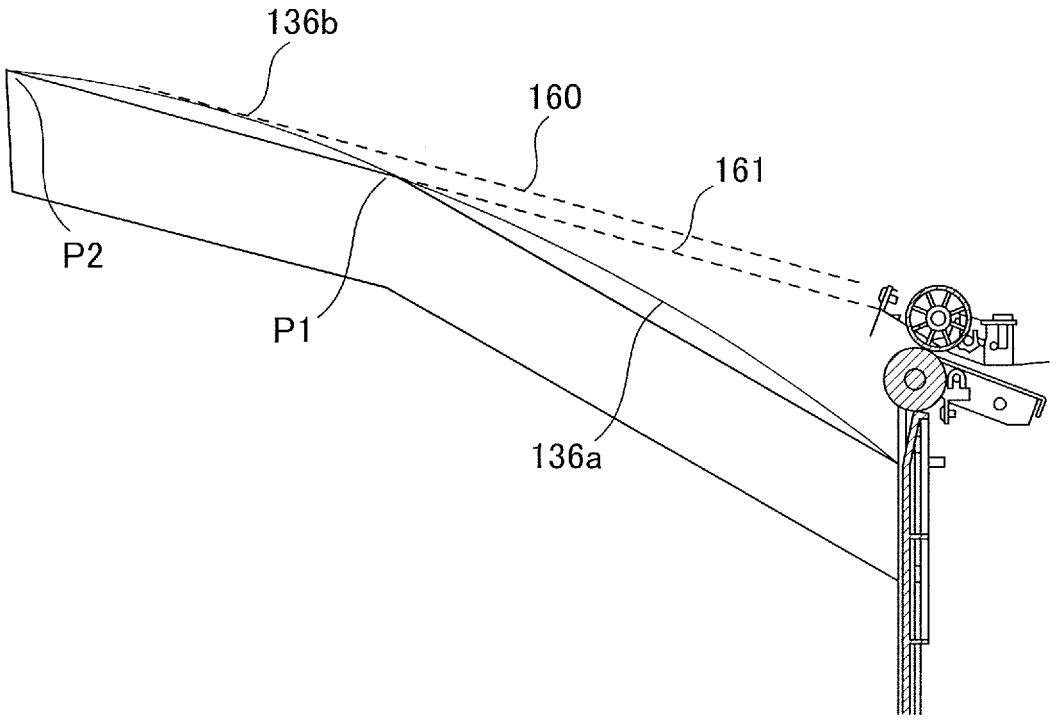
FIG. 15 illustrates another configuration of the upper tray.

The upper tray 136 can adopt a shape as illustrated in FIG. 15, where the first and second support surfaces 136*a* and 136*b* are respectively R-shaped and connected with curvatures of different angles. In the case of such a tray, a line 161 connecting a curvature point P1 between the first and second support surfaces 136*a* and 136*b* and a downstream end P2 of a second support surface, or a line 160 parallel with the line 161 and being a tangent of the second support surface 136*b* is set as an extension line of the second support surface 136*b*.

According further to the present embodiment, a basis weight entered from the operation unit 601 is used as the stiffness information, but in the case of a system in which the stiffness can be entered directly, or in a system where stiffness can be entered via a value other than the basis weight, the position control of the upper tray 136 can be performed according to such stiffness information.

In the present embodiment, when supporting a sheet having a high stiffness, the tray is moved to the second position regardless of the sheet size. However, in a sheet having a short length in the sheet discharging direction, such as an A4 sheet or a LTR sheet, the position of the center of gravity of the sheet being supported on the tray may be positioned upstream in the sheet discharge direction of the boundary between the first and second support surfaces. In that case, when the sheet is discharged onto the tray, the sheet will only be supported by the first support surface, and the upstream end SR of the sheet will not lean against the upper sheet discharge roller pair 120. Therefore, even in the high stiffness sheet, if the sheet has a short length in the sheet discharge direction, the sheet can be discharged onto the tray moved to the first position.

Figure 16:
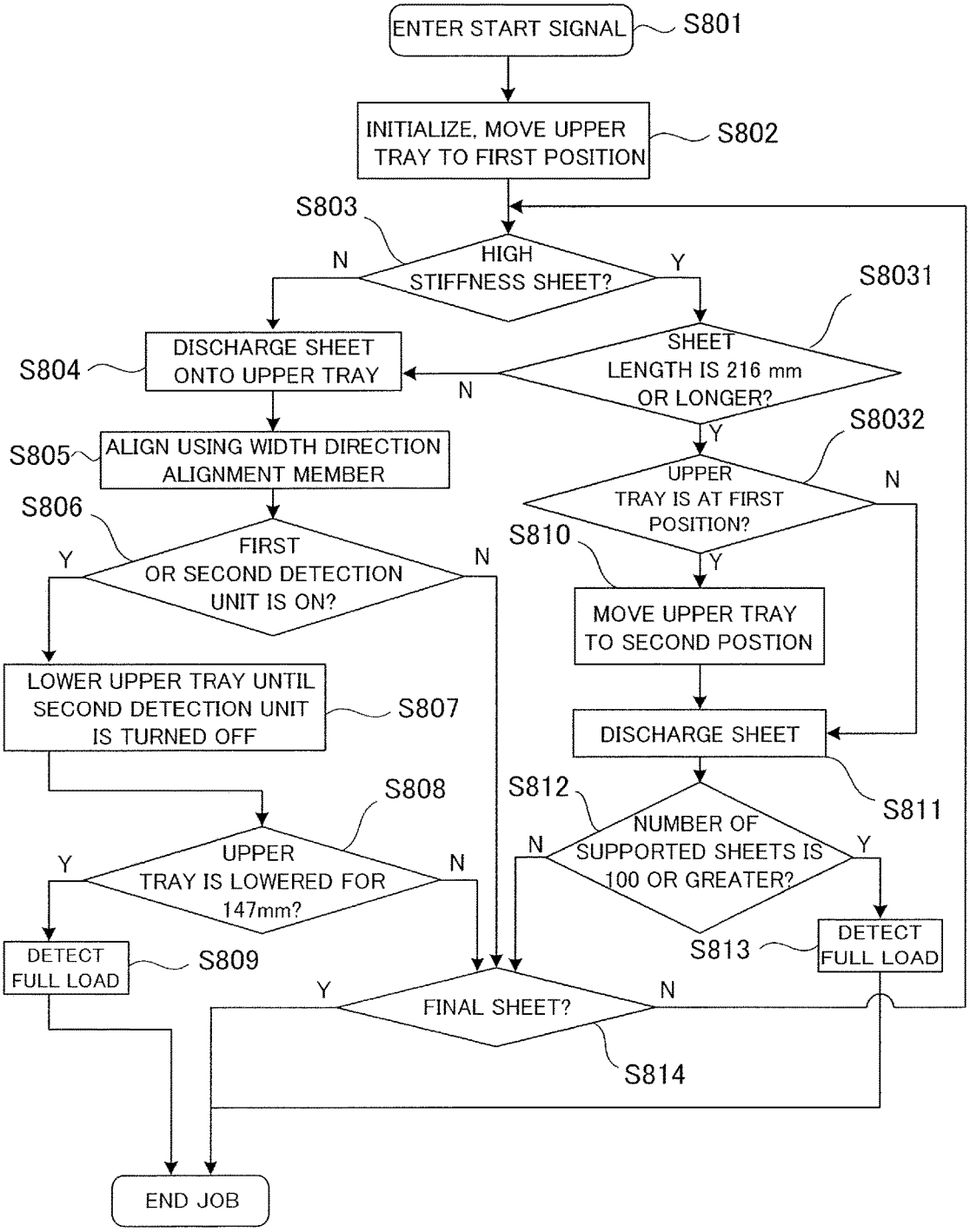
FIG. 16 is a flowchart illustrating an operation in which a sheet is discharged and supported on a sheet supporting device according to a second embodiment of the present invention.

Next, a second embodiment of the present invention in which the height position of the tray is changed in accordance with the length of the sheet in the sheet discharge direction will be described with reference to FIG. 16. In the present embodiment, the length in the sheet discharge direction is determined by the identification unit 713, which is a length information input unit coupled to the support tray controller 711, as illustrated in FIG. described earlier. In the present embodiment, the identification unit 713 is provided on either the finisher 100 or the copying machine body 602, and it determines (judges) whether the length of the sheet in the sheet discharge direction, i.e., sheet discharge direction length, is equal to or greater than 216 mm. The length, i.e., size, of the sheet in the sheet conveyance direction can be entered through the operation unit 601, and in that case, the operation unit 601 constitutes a length information input unit.

When a start signal is entered from the operation unit 601 of the black-and-white/color copying machine 600 (step S801), the finisher controller 636 initializes the respective members, and moves the upper tray 136 to a first position where only the third detection unit 510*c* is turned on (step S802). Next, based on the sheet information from the operation unit 601, the finisher controller 636 determines whether the sheet is a high stiffness sheet (step S803). If the sheet is not a high stiffness sheet (step S803: N) and it is a sheet having a low stiffness, such as a normal paper, the sheet is discharged onto the upper tray 136 with the upper tray 136 remaining at the first position (step S804). The subsequent operations are the same as the operations S805 through S809 in the flowchart illustrated in FIG. 14 described earlier, so that the description thereof will be omitted.

If the sheet is a high stiffness sheet (step S803: Y), whether the length of the sheet in the sheet conveyance direction is 216 mm or greater is determined by the identification unit 713 (step S8031). In the present embodiment, the distance from the abutment member 85 to the bend point 136*d* between the first and second support surfaces 136*a* and 136*b* of the upper tray 136 is approximately 220 mm. Further, since the sheet conveyance direction length of an LTR-size sheet, which is a popular sheet size, is 215.9 mm, the judgment of step S8031 is switched based on whether the sheet is equal to or smaller than 215.9 mm, or equal to or greater than 216 mm.

If it is determined based on the length information from the identification unit 713 that the sheet length is smaller than 216 mm (step S8031: N), the sheet is discharged onto the upper tray 136 in the state where the upper tray 136 is positioned as it is at the first position (step S804). The subsequent operations are the same as the operations of S805 through S809 in the flowchart illustrated in FIG. 14 described earlier, so that the description thereof will be omitted.

On the other hand, if it is determined that the sheet length is equal to or greater than 216 mm (step S8031: Y), the finisher controller 636 confirms whether the upper tray 136 is positioned at the first position (step S8032). If the upper tray 136 is at the first position (step S8032: Y), the upper tray 136 is lowered for 40 mm and moved to a second position where the second detection unit 510*b* is turned ON (step S810). The subsequent operations are the same as the operations of S811 through S813 of the flowchart illustrated in FIG. 14 described earlier, so that the descriptions thereof will be omitted.

As described, according to the present embodiment, the height position of the upper tray 136 is changed in accordance with the discharged sheet length, even in the case of a high stiffness sheet. In other words, if the sheet has a length where the position of the center of gravity is positioned upstream in the sheet discharge direction of the boundary, i.e., bend point 136*d*, between the first and second support surfaces when the sheet length is supported on the upper tray 136, the upper tray 136 is controlled to be positioned at the first position. Such control enables the width-direction alignment member 1 to perform an alignment operation even in a high stiffness sheet.

In the above description, the switching of the height position of the upper tray 136 is performed based on whether the length of the sheet in the sheet conveyance direction, i.e., sheet discharge direction, is 216 mm or greater. However, the present embodiment is not restricted to this example, and based on a concept that the position of center of gravity of the sheet should preferably not exceed the bend point 136*d*, the sheet having a length equal to or shorter than twice the distance between the abutment member 85 and the bend point 136*d*, i.e., the length of the second support surface 136*b*, can be set to the first discharge mode, regardless of the stiffness of the sheet. Moreover, either one roller or both rollers of the discharge roller pair 120 can be replaced with a belt or other rotators.

According to the first and second embodiments described above, the width-direction alignment member 1 does not perform alignment operation of a high stiffness sheet having a long length in the conveyance direction. However, if the tray receives the high stiffness sheet at the second position and then moves to the first position, the alignment of the sheet in the width direction by the width-direction alignment member is enabled. Then, the tray can be moved to the second position after alignment of the sheet in the width direction is ended and before the next sheet is discharged.

A high stiffness sheet with a long size supported on both the first and second support surfaces can be aligned in the width direction by repeating the above-described operation. According to such control mode, the printing productivity is deteriorated since a waiting time occurs each time the tray is moved up and down for each sheet, but the mode is effective for users placing importance in the alignment of sheets. It is preferable that the modes can be selectively switched between a mode that does not perform such uniform alignment and a mode having deteriorated productivity due to the up-down movement of the tray but capable of achieving a high alignment performance.

An example has been illustrated where the present invention is applied to a sheet supporting device 100C provided on the finisher 100, but needless to say, the present invention can also be applied to a sheet supporting device provided on the image forming apparatus, i.e., copying machine body 602. Moreover, the arrangement of the identification unit, the counter and the operation unit is not restricted to the arrangement of the present embodiment. When the present invention is applied to an image forming apparatus, the identification unit, the counter and the operation unit can be arranged on either the sheet processing apparatus or the image forming apparatus.

Further, the position of the upper tray 136 according to the first discharge mode, i.e., first position, should merely be higher than the position of the upper tray 136 according to the second discharge mode, i.e., second position, and in the first discharge mode, the upper tray 136 can be arranged at a position where the intersection C is positioned lower than the nip N of the upper sheet discharge roller pair 120.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment (s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-127847, filed Jun. 25, 2015, which is hereby incorporated by reference herein in its entirety.

What is claimed is:

1. An image forming apparatus comprising:

an image forming unit configured to form an image on a sheet;

a discharge rotary member pair configured to discharge the sheet on which the image has been formed by the image forming unit;

a sheet supporting unit configured to support the sheet discharged through the discharge rotary member pair, the sheet supporting unit comprising a first support surface, and a second support surface provided downstream, in a sheet discharge direction, of the first support surface, and having a smaller inclination angle than the first support surface with respect to a horizontal plane;

an abutment surface configured to abut against an upstream end, in the sheet discharge direction, of the sheet supported on the sheet supporting unit;

an elevation unit configured to move the sheet supporting unit up and down; and a control unit, in a state where no sheet is supported on the sheet supporting unit, configured to execute (1) a first discharge mode of controlling the elevation unit such that the sheet supporting unit is positioned at a first position where a first intersection between a first extension line of the second support surface and a plane including the abutment surface is positioned higher than a nip of the discharge rotary member pair before the discharge rotary member pair starts discharging the sheet, and (2) a second discharge mode of controlling the elevation unit such that the sheet supporting unit is positioned at a second position lower than the first position and where a second intersection between a second extension line of the second support surface and the plane including the abutment surface is positioned lower than the nip of the discharge rotary member pair before the discharge rotary member pair starts discharging the sheet, wherein the control unit executes the first discharge mode in a case where a type of sheet to be discharged by the discharge rotary member pair is a first type, and executes the second discharge mode in a case where a type of sheet to be discharged by the discharge rotary member pair is a second type, and the sheet of the second type has a higher stiffness than that of the sheet of the first type.

2. The image forming apparatus according to claim 1, wherein the discharge rotary member pair comprises an upper rotary member, and a lower rotary member provided below the upper rotary member, and a downstream end of the lower rotary member in the sheet discharge direction is positioned higher than the second intersection in a case where the sheet supporting unit is positioned at the second position.

3. The image forming apparatus according to claim 2, wherein the second extension line crosses the lower rotary member in a case where the sheet supporting unit is positioned at the second position.

4. The image forming apparatus according to claim 1, further comprising a length information input unit configured to input a length of the sheet in the discharging direction to the control unit, wherein the control unit executes the first discharge mode regardless of the type of sheet in a case where the length, input by the length information input unit, of the sheet being discharged is equal to or shorter than twice a length of the first support surface before the discharge rotary member pair starts discharging the sheet.

5. The image forming apparatus according to claim 1, wherein the discharge rotary member pair continuously discharges the sheet while lowering the sheet supporting unit from the first position in accordance with a sheet support amount in the first discharge mode after the discharge rotary member pair starts discharging the sheet, and continuously discharges the sheet in a state where the sheet supporting unit is positioned at the second position regardless of the sheet support amount in the second discharge mode.

6. The image forming apparatus according to claim 5, wherein the control unit detects full load state of the sheet supporting unit based on a position of the sheet supporting unit in an up-down direction in the first discharge mode, and detects the full load state based on a number of discharged sheets to the sheet supporting unit in the second discharge mode.

7. The image forming apparatus according to claim 1, further comprising an alignment unit configured to align a position of an end portion of the sheet, in a width direction orthogonal to the sheet discharge direction, discharged onto the sheet supporting unit, wherein the control unit drives the alignment unit in a case where the sheet supporting unit is positioned at the first position, and does not drive the alignment unit in a case where the sheet supporting unit is positioned at the second position.

8. The image forming apparatus according to claim 7, wherein the control unit drives the alignment unit after moving the sheet supporting unit on which the sheet has been discharged from the second position to the first position in the second discharge mode.

9. A sheet processing apparatus comprising:

a sheet processing unit configured to process a sheet;

a discharge rotary member pair configured to discharge the sheet having been processed by the sheet processing unit;

a sheet supporting unit configured to support the sheet discharged through the discharge rotary member pair, the sheet supporting unit comprising a first support surface, and a second support surface provided downstream, in a sheet discharge direction, of the first support surface, and having a smaller inclination angle than the first support surface with respect to a horizontal plane;

an abutment surface configured to abut against an upstream end, in the sheet discharge direction, of the sheet supported on the sheet supporting unit;

an elevation unit configured to move the sheet supporting unit up and down; and a control unit, in a state where no sheet is supported on the sheet supporting unit, configured to execute (1) a first discharge mode of controlling the elevation unit such that the sheet supporting unit is positioned at a first position where a first intersection between a first extension line of the second support surface and a plane including the abutment surface is positioned higher than a nip of the discharge rotary member pair before the discharge rotary member pair starts discharging the sheet, and (2) a second discharge mode of controlling the elevation unit such that the sheet supporting unit is positioned at a second position lower than the first position and where a second intersection between a second extension line of the second support surface and the plane including the abutment surface is positioned lower than the nip of the discharge rotary member pair before the discharge rotary member pair starts discharging the sheet, wherein the control unit executes the first discharge mode in a case where a type of sheet to be discharged by the discharge rotary member pair is a first type, and executes the second discharge mode in a case where a type of sheet to be discharged by the discharge rotary member pair is a second type, and the sheet of the second type has a higher stiffness than that of the sheet of the first type.

10. The sheet processing apparatus according to claim 9, wherein the discharge rotary member pair comprises an upper rotary member, and a lower rotary member provided below the upper rotary member, and a downstream end of the lower rotary member in the sheet discharge direction is positioned higher than the second intersection in a case where the sheet supporting unit is positioned at the second position.

11. The sheet processing apparatus according to claim 10, wherein the second extension line crosses the lower rotary member in a case where the sheet supporting unit is positioned at the second position.

12. The sheet processing apparatus according to claim 9, further comprising a length information input unit configured to input a length of the sheet in the discharging direction to the control unit, wherein the control unit executes the first discharge mode regardless of the type of sheet in a case where the length, input by the length information input unit, of the sheet being discharged is equal to or shorter than twice a length of the first support surface before the discharge rotary member pair starts discharging the sheet.

13. The sheet processing apparatus according to claim 9, wherein the discharge rotary member pair continuously discharges the sheet while lowering the sheet supporting unit from the first position in accordance with a sheet support amount in the first discharge mode after the discharge rotary member pair starts discharging the sheet, and continuously discharges the sheet in a state where the sheet supporting unit is positioned at the second position regardless of the sheet support amount in the second discharge mode.

14. The sheet processing apparatus according to claim 13, wherein the control unit detects full load state of the sheet supporting unit based on a position of the sheet supporting unit in an up-down direction in the first discharge mode, and detects the full load state based on a number of discharged sheets to the sheet supporting unit in the second discharge mode.

15. The sheet processing apparatus according to claim 9, further comprising an alignment unit configured to align a position of an end portion of the sheet, in a width direction orthogonal to the sheet discharge direction, discharged onto the sheet supporting unit, wherein the control unit drives the alignment unit in a case where the sheet supporting unit is positioned at the first position, and does not drive the alignment unit in a case where the sheet supporting unit is positioned at the second position.

16. The sheet processing apparatus according to claim 15, wherein the control unit drives the alignment unit after moving the sheet supporting unit on which the sheet has been discharged from the second position to the first position in the second discharge mode.

17. The image forming apparatus according to claim 1, further comprising:

a sheet stacking portion configured to stack the sheet which is conveyed toward the image forming unit, and a store portion configured to store information about which type of the sheet is stacked on the sheet stacking portion, wherein the control unit executes the first discharge mode or the second discharge mode based on the information stored in the store portion.

18. The sheet processing apparatus according to claim 9, further comprising:

a sheet stacking portion configured to stack the sheet which is conveyed toward the sheet processing unit, and a store portion configured to store information about which type of the sheet is stacked on the sheet stacking portion, wherein the control unit executes the first discharge mode or the second discharge mode based on the information stored in the store portion.

* * * * *